US009597769B2

(12) United States Patent
Lefevre et al.

(10) Patent No.: US 9,597,769 B2
(45) Date of Patent: Mar. 21, 2017

(54) POLISHING PAD WITH POLISHING SURFACE LAYER HAVING AN APERTURE OR OPENING ABOVE A TRANSPARENT FOUNDATION LAYER

(75) Inventors: Paul Andre Lefevre, Portland, OR (US); William C. Allison, Beaverton, OR (US); James P. LaCasse, Portland, OR (US); Diane Scott, Portland, OR (US); Alexander William Simpson, Hillsboro, OR (US); Ping Huang, Beaverton, OR (US); Leslie M. Charns, Portland, OR (US)

(73) Assignee: NexPlanar Corporation, Hillsboro, OR (US)

( * ) Notice: Subject to any disclaimer, the term of this patent is extended or adjusted under 35 U.S.C. 154(b) by 873 days.

(21) Appl. No.: 13/488,149

(22) Filed: Jun. 4, 2012

(65) Prior Publication Data

US 2013/0324020 A1 Dec. 5, 2013

(51) Int. Cl.
*B24B 37/20* (2012.01)
*B24B 37/22* (2012.01)
(Continued)

(52) U.S. Cl.
CPC ..... *B24B 37/205* (2013.01); *B24B 37/16* (2013.01); *B24B 37/22* (2013.01); *B24B 37/26* (2013.01);
(Continued)

(58) Field of Classification Search
CPC ..... B24B 37/16; B24B 37/20; B24B 37/205; B24B 37/22; B24B 37/26; B24D 11/003
(Continued)

(56) References Cited

U.S. PATENT DOCUMENTS 1,953,983 A 4/1934 Benner
5,007,207 A 4/1991 Phaal
(Continued)

FOREIGN PATENT DOCUMENTS

CA 2 598 272 8/2006
CN 1805826 7/2006
(Continued)

OTHER PUBLICATIONS

International Preliminary Report on Patentability from PCT/US2013/043126 mailed Dec. 18, 2014, 8 pgs.
(Continued)

*Primary Examiner* — Eileen Morgan
(74) *Attorney, Agent, or Firm* — Thomas Omholt; Erika Wilson; Justin K. Brask

(57) ABSTRACT

Polishing pads with a polishing surface layer having an aperture or opening above a transparent foundation layer are described. In an example, a polishing pad for polishing a substrate includes a foundation layer having a global top surface and a transparent region. A polishing surface layer is attached to the global top surface of the foundation layer. The polishing surface layer has a polishing surface and a back surface. An aperture is disposed in the polishing pad from the back surface through to the polishing surface of the polishing surface layer, and aligned with the transparent region of the foundation layer. The foundation layer provides an impermeable seal for the aperture at the back surface of the polishing surface layer. Methods of fabricating such polishing pads are also described.

59 Claims, 10 Drawing Sheets

(51) Int. Cl.

| | |
|---|---|
| ***B24B 37/26*** | (2012.01) |
| ***B24B 37/16*** | (2012.01) |
| ***B24D 11/00*** | (2006.01) |
| ***B24D 18/00*** | (2006.01) |

(52) U.S. Cl.
CPC ..... *B24D 11/003* (2013.01); *B24D 18/0009* (2013.01)

(58) Field of Classification Search
USPC ..... 451/41, 285, 287, 527, 529, 533
See application file for complete search history.

(56) References Cited

U.S. PATENT DOCUMENTS

| | | | | |
|---|---|---|---|---|
| 5,190,568 | A | 3/1993 | Tselesin | |
| 5,212,910 | A | 5/1993 | Breivogel et al. | |
| 5,609,517 | A | 3/1997 | Lofaro | |
| 5,823,855 | A | 10/1998 | Robinson | |
| 5,893,796 | A | 4/1999 | Birang et al. | |
| 5,921,855 | A | 7/1999 | Osterheld et al. | |
| 5,958,794 | A | 9/1999 | Bruxvoort et al. | |
| 6,019,666 | A | 2/2000 | Roberts et al. | |
| 6,089,965 | A | 7/2000 | Otawa et al. | |
| 6,179,887 | B1 | 1/2001 | Barber, Jr. | |
| 6,183,346 | B1 | 2/2001 | Gagliardi et al. | |
| 6,217,426 | B1 | 4/2001 | Tolles et al. | |
| 6,413,153 | B1 | 7/2002 | Molar | |
| 6,454,634 | B1 * | 9/2002 | James | B24B 37/042 451/285 |
| 6,498,101 | B1 | 12/2002 | Wang | |
| 6,544,306 | B2 | 4/2003 | Suzuki et al. | |
| 6,544,373 | B2 | 4/2003 | Chen et al. | |
| 6,575,825 | B2 | 6/2003 | Tolles et al. | |
| 6,736,709 | B1 | 5/2004 | James et al. | |
| 6,838,169 | B2 | 1/2005 | Obeng | |
| 6,884,156 | B2 | 4/2005 | Prasad et al. | |
| 7,029,747 | B2 | 4/2006 | Huh et al. | |
| 7,169,029 | B2 | 1/2007 | Petersen et al. | |
| 7,198,549 | B2 | 4/2007 | Steckenrider et al. | |
| 7,201,647 | B2 | 4/2007 | Lombardo et al. | |
| 7,235,114 | B1 | 6/2007 | Minick et al. | |
| 7,530,880 | B2 | 5/2009 | Bajaj et al. | |
| 7,846,008 | B2 | 12/2010 | Bajaj | |
| 8,393,940 | B2 * | 3/2013 | Swedek | B24B 37/205 264/263 |
| 2002/0042243 | A1 | 4/2002 | Ihsikawa et al. | |
| 2003/0129931 | A1 * | 7/2003 | Konno | B24B 37/205 451/285 |
| 2004/0248508 | A1 | 12/2004 | Lombardo | |
| 2004/0259484 | A1 * | 12/2004 | Prasad | B24D 3/32 451/287 |
| 2005/0014376 | A1 | 1/2005 | Shiho et al. | |
| 2005/0020082 | A1 * | 1/2005 | Vishwanathan | B24B 37/042 438/690 |
| 2005/0032462 | A1 | 2/2005 | Gagliardi et al. | |
| 2005/0197050 | A1 | 9/2005 | Prasad et al. | |
| 2005/0221723 | A1 * | 10/2005 | Duboust | B24B 37/013 451/41 |
| 2006/0037699 | A1 | 2/2006 | Nakamori et al. | |
| 2007/0049167 | A1 | 3/2007 | Swedek et al. | |
| 2007/0212979 | A1 | 9/2007 | Preston | |
| 2009/0137189 | A1 * | 5/2009 | Fukuda | B24B 37/205 451/6 |
| 2009/0145045 | A1 | 6/2009 | Sung | |
| 2009/0176443 | A1 | 7/2009 | Kollodge et al. | |
| 2010/0279585 | A1 * | 11/2010 | Zhang | B24B 37/013 451/6 |
| 2010/0330879 | A1 * | 12/2010 | Paik | B24B 37/205 451/6 |
| 2011/0053377 | A1 * | 3/2011 | Ogawa | B24B 37/205 438/692 |
| 2012/0302148 | A1 | 11/2012 | Bajaj et al. | |
| 2013/0137349 | A1 | 5/2013 | Lefevre et al. | |
| 2013/0137350 | A1 | 5/2013 | Allison et al. | |

FOREIGN PATENT DOCUMENTS

| | | |
|---|---|---|
| CN | 101107095 | 1/2008 |
| CN | 101443157 | 5/2009 |
| CN | 101636247 | 1/2010 |
| EP | 1252973 | 10/2002 |
| EP | 1306163 | 5/2003 |
| EP | 1 498 222 | 1/2005 |
| JP | 2004243428 | 9/2004 |
| JP | P2005-508261 | 3/2005 |
| JP | 2006239833 | 9/2006 |
| JP | 3851135 | 11/2006 |
| JP | 2007-044814 | 2/2007 |
| JP | P2007-506280 | 3/2007 |
| JP | 2008528309 | 7/2008 |
| JP | P2008-546167 | 12/2008 |
| JP | 2009-033193 | 2/2009 |
| JP | 2009-060044 | 3/2009 |
| JP | 2010029996 | 2/2010 |
| JP | 2010528885 | 8/2010 |
| JP | 2011-67946 | 4/2011 |
| KR | 10-2006-0127219 | 12/2006 |
| TW | 220002 | 2/1994 |
| TW | 539596 | 7/2003 |
| TW | 541225 | 7/2003 |
| TW | I221105 | 9/2004 |
| TW | I298667 | 7/2008 |
| TW | I311512 | 7/2009 |
| WO | WO-01/91971 | 12/2001 |
| WO | WO-01/94074 | 12/2001 |
| WO | WO-03/039812 | 5/2003 |
| WO | WO-2005/032765 | 4/2005 |
| WO | WO-2005/099962 | 10/2005 |
| WO | WO-2006/081286 | 8/2006 |
| WO | WO-2006/089293 | 8/2006 |
| WO | WO-2008154185 | 12/2008 |
| WO | WO-2010/126901 | 11/2010 |
| WO | WO-2012/005778 | 1/2012 |
| WO | WO-2013/012608 | 1/2013 |
| WO | WO-2013/081665 | 6/2013 |

OTHER PUBLICATIONS

International Search Report and Written Opinion from PCT/US2013/043126 mailed Aug. 6, 2013, 12 pgs.
International Preliminary Report on Patentability from PCT/US2012/038211 mailed Jun. 12, 2014, 6 pgs.
Non-Final Office Action for Japan Patent Application No. 2014-511502, mailed Jul. 17, 2014, 8 pgs.
International Search Report and Written Opinion from PCT/US2012/038211 mailed Aug. 10, 2012, 8 pgs.
Taiwan Search Report from Taiwan Patent Application No. 101118246 mailed Oct. 14, 2014, 1 pg.
Taiwan Search Report from Taiwan Patent Application No. 101118247 mailed Oct. 15, 2014, 1 pg.
Notification of Grounds for Refusal received in Korean Patent Application No. 10-2013-7029736 mailed Feb. 27, 2015, 13 pgs.
Extended European Search Report received in European Patent Application No. 14198969.9 mailed Mar. 11, 2015, 5 pgs.
International Search Report and Written Opinion from PCT/US2012/038212 mailed Aug. 8, 2012, 20 pgs.
International Preliminary Report on Patentability from PCT/US2012/038212 mailed Dec. 5, 2013, 7 pgs.
Office Action and Search Report from Taiwan Patent Application No. 102119630 mailed Oct. 6, 2015, 25 pgs.
Search Report and Written Opinion from Singapore Patent Application No. 11201407839P mailed Nov. 12, 2015, 12 pgs.
Notification of Grounds for Refusal from Korean Patent Application No. 10-2014-7036283 mailed Dec. 17, 2015, 11 pgs.
Notice of Reasons for Rejection from Japanese Patent Application No. 2015-515155 mailed Oct. 29, 2015, 10 pgs.
Office Action for Korean Patent Application No. 10-2014-0736283, mailed May 3, 2016, 8 pgs.
Office Action for Korean Patent Application No. 10-2016-7007025, mailed Apr. 5, 2016, 18 pgs.

(56) References Cited

OTHER PUBLICATIONS

Office Action for Chinese Patent Application No. 201380041299.9, mailed Jan. 1, 2016, 16 pgs.

* cited by examiner

POLISHING PAD WITH POLISHING SURFACE LAYER HAVING AN APERTURE OR OPENING ABOVE A TRANSPARENT FOUNDATION LAYER

TECHNICAL FIELD

Embodiments of the present invention are in the field of chemical mechanical polishing (CMP) and, in particular, polishing pads with a polishing surface layer having an aperture or opening above a transparent foundation layer.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads with a polishing surface layer having an aperture or opening above a transparent foundation layer.

In an embodiment, a polishing pad for polishing a substrate includes a foundation layer having a global top surface and a transparent region. A polishing surface layer is attached to the global top surface of the foundation layer. The polishing surface layer has a polishing surface and a back surface. An aperture is disposed in the polishing pad from the back surface through to the polishing surface of the polishing surface layer, and aligned with the transparent region of the foundation layer. The foundation layer provides an impermeable seal for the aperture at the back surface of the polishing surface layer.

In another embodiment, a polishing pad for polishing a substrate includes a foundation layer having a global top surface and a transparent region. A polishing surface layer is attached to the global top surface of the foundation layer. The polishing surface layer has a polishing surface and a back surface. An opening is disposed in the polishing pad from the polishing surface, but not through to the back surface, of the polishing surface layer. The opening is aligned with the transparent region of the foundation layer.

In another embodiment, a method of fabricating a polishing pad for polishing a substrate includes providing, in a formation mold, a foundation layer and a mixture formed from mixing a set of polymerizable materials. The foundation layer has a transparent region. A pattern of grooves of the formation mold is coupled with the mixture. With the pattern of grooves coupled with the mixture, the mixture is at least partially cured to form a molded homogeneous polishing surface layer directly on the foundation layer. The molded homogeneous polishing surface layer includes a pattern of protrusions corresponding to the pattern of grooves of the formation mold. An aperture or opening is formed in the polishing surface layer, aligned with the transparent region of the foundation layer.

DETAILED DESCRIPTION

Figure 1:
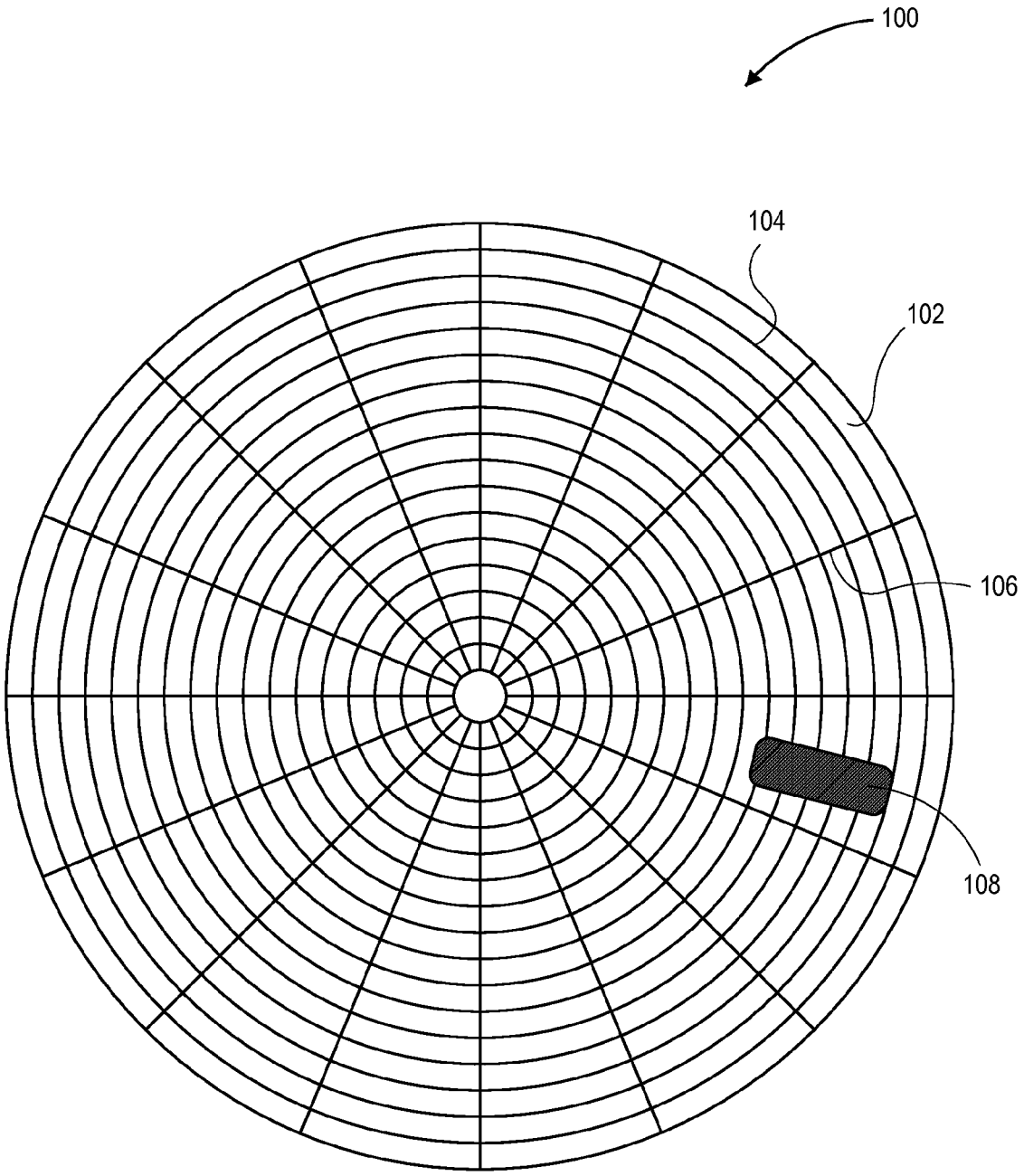
FIG. 1 illustrates a top-down plan view of a polishing pad having a window disposed therein.

Polishing pads with a polishing surface layer having an aperture or opening above a transparent foundation layer are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

One or more embodiments described herein are directed to a detection system composed of an aperture or opening formed in a polishing layer of a polishing pad. The aperture or opening may be used in conjunction with an aperture-free transparent foundation layer having the polishing layer disposed thereon. Embodiments of polishing pads described herein may be used for end-point detection (EPD) in a chemical mechanical polishing process. As used herein, an aperture generally refers to a hole formed throughout an entirety of a layer or pad described as having the aperture therein. By contrast, an opening generally refers to an incomplete hole (e.g., a trench or partial aperture) formed at one surface of, but not throughout an entirety of, a layer or pad described as having the opening therein. Specific embodiments include, but are not limited to, a polishing pad having one or more of (1) an aperture disposed in a polishing surface layer and over an optically transparent foundation layer, (2) an aperture disposed in a polishing surface layer and over an opening or local slurry deflection system formed in a transparent foundation layer, (3) an opening or slurry defection system disposed in a polishing surface layer and over an optically transparent foundation layer, and (4) an opening or slurry defection system disposed in a polishing surface layer and over an opening or local slurry deflection system of an optically transparent foundation layer. It is to be understood that embodiments are not limited to a foundation layer that is entirely transparent. In an embodiment, reference to a transparent foundation layer indicates that at least a portion or region of the foundation layer is transparent. Openings or apertures in a polishing surface layer residing above the foundation layer do so (e.g., are aligned with) the transparent portion of the foundation layer.

For a more thorough understanding, in a first aspect, features may need to be introduced to polishing pads for advanced chemical mechanical polishing processing. For example, otherwise opaque polishing pads may have one or more "windows" included therein to allow a substantial transmission of visible light for various monitoring applications. One such monitoring application may involve use of an optical device mounted within or on a chemical mechanical polishing apparatus. The optical device is used to monitor a chemical mechanical polishing process by, e.g., reflectance changes in the substrate undergoing polishing. The process is monitored through the window of the polishing pad since the polishing occurs at a top polishing surface of the polishing pad. The window is typically formed by inserting a transparent plug into the pad or by molding a transparent region (e.g., a local area transparency region or LAT) into an otherwise opaque pad at the time of fabrication. In either case, the window is composed of a distinct material included in the pad.

In accordance with an embodiment of the present invention, a "windowless" polishing pad suitable for optical monitoring there through is provided. As an example, an aperture or opening is provided in a polishing surface layer of a polishing pad allowing for optical monitoring through the polishing pad. In one embodiment, the aperture or opening is a complete or incomplete hole made in the polishing surface layer that extends through the entire polishing surface layer. Thus, in contrast to a pad including a window composed of a material, the windowless polishing pad is characterized by the absence of material.

Conventionally, a mere hole formed in a polishing pad would have been unsuitable for monitoring a chemical mechanical process. For example, slurry would have been able to escape through the pad, possibly eroding an underlying optical monitoring device. In another example, a hole that fills with an opaque slurry may be unsuitable for allowing sufficient light transmission for optical detection. However, advanced slurries now being tested or in use are relatively, if not entirely, transparent.

As such, in an embodiment of the present invention, filling of an aperture or opening with a slurry does not detrimentally impact optical detection. Furthermore, in an embodiment, a transparent foundation layer is included below the polishing surface layer. In one such embodiment, the transparent foundation layer provides a seal to protect a platen and, e.g., a quartz laser site of a chemical mechanical polishing apparatus. As described in more detail below, various aperture or opening designs are provided. In some embodiments, the designs include provisions to keep a slurry flushing across the opening or aperture during a polishing process. In a specific such embodiment, an aperture designed for slurry flushing is used to prevent polishing debris from collecting, agglomerating, and potentially attenuating the laser or other optical signal.

Conventional "window" polishing pads typically have an insert or LAT region of a material suitably transparent included therein. For example, FIG. 1 illustrates a top-down plan view of a polishing pad having a window disposed therein.

Referring to FIG. 1, a polishing pad 100 includes a polishing body having a polishing surface 102 and a back surface (not shown). The polishing surface 102 has a pattern of concentric circumferential grooves 104. The pattern of grooves also includes a plurality of radial grooves 106 continuous from the inner most circumferential groove to the outer most circumferential groove. A window 108 is included in the polishing pad 100 and is visible from the polishing surface 102. The window is composed of a suitably transparent material such as a plug (or insert) or an LAT region, as described above. It is noted that, although not necessarily always the case, conventional polishing pads typically have concentric circular groove patterns, as depicted in FIG. 1.

In a second aspect, polishing pads for CMP operations may have trade-offs in performance such as a trade-off between across-wafer polishing uniformity versus within die polishing uniformity. For example, hard polishing pads may exhibit good die-level planarization, but poor across-wafer uniformity. They may also scratch a substrate being polished. On the other hand, soft polishing pads may exhibit poor die-level planarization (e.g., they may cause dishing within die), but good wafer-level uniformity. An approach to mitigating the above performance trade-off may be to decouple within-wafer and within-die polishing effects.

Conventional approaches to fabricating and using soft pads may have limitations. For example, casted soft pads may offer low defect characteristics but compromised planarization performance. There may be a need for polishing pads that offer both low defect characteristics yet high planarization performance during polishing operations. Similarly, conventional approaches to fabricating and using hard pads may have limitations. For example, faster gelling speeds possibly inherent in harder urethane formulations may force process compromises that impact pad uniformity and limit formulation options. There may be a need for an approach suitable to produce and implement hard pads that avoid such compromises. Additionally, as noted above, it may be desirable to decouple the properties of the polishing surface of a pad from its bulk properties, such that the properties of each may be separately optimized.

In accordance with an embodiment of the present inventions, polishing pads with bulk or foundation material different from the material of the polishing surface are described herein. Such polishing pads may be fabricated or implemented in approaches suitable to address the above described compromises made for conventional pads. In one embodiment, a composite polishing pad includes a foundation or bulk layer fabricated from a stable, essentially non-compressible, inert material onto which a polishing surface layer is disposed. A harder foundation layer may provide support and strength for pad integrity while a softer polishing surface layer may reduce scratching, enabling decoupling of the material properties of the polishing layer and the remainder of the polishing pad.

In a specific embodiment elaborated in greater detail below, the planarization characteristics of a soft pad is made available by producing a soft polishing surface layer on a stiff backer material or foundation layer, such as a sheet of polycarbonate. Other possibilities include use of a polyethylene terephthalate (PET) material, a PETG material, glass, quartz, an acrylic material, MMA or polystyrene. In accordance with embodiments of the present invention, approaches to mitigating the above described performance trade-off include the formation of polishing pads having either a soft continuous polishing surface layer or a soft polishing surface layer composed of discrete protrusions bonded with a hard foundation layer. Although the foregoing may be preferred, it is to be understood that reverse arrangements, e.g., a hard polishing surface layer disposed on a soft underlying foundation layer, are also contemplated and described herein.

In an aspect of the present invention, a windowless polishing pad suitable for optical monitoring includes a polishing surface layer having an aperture there through or an opening therein. For example, FIG. 2 illustrates a top-down plan view of a polishing pad with an aperture or opening in the polishing surface layer, in accordance with an embodiment of the present invention.

Figure 2:
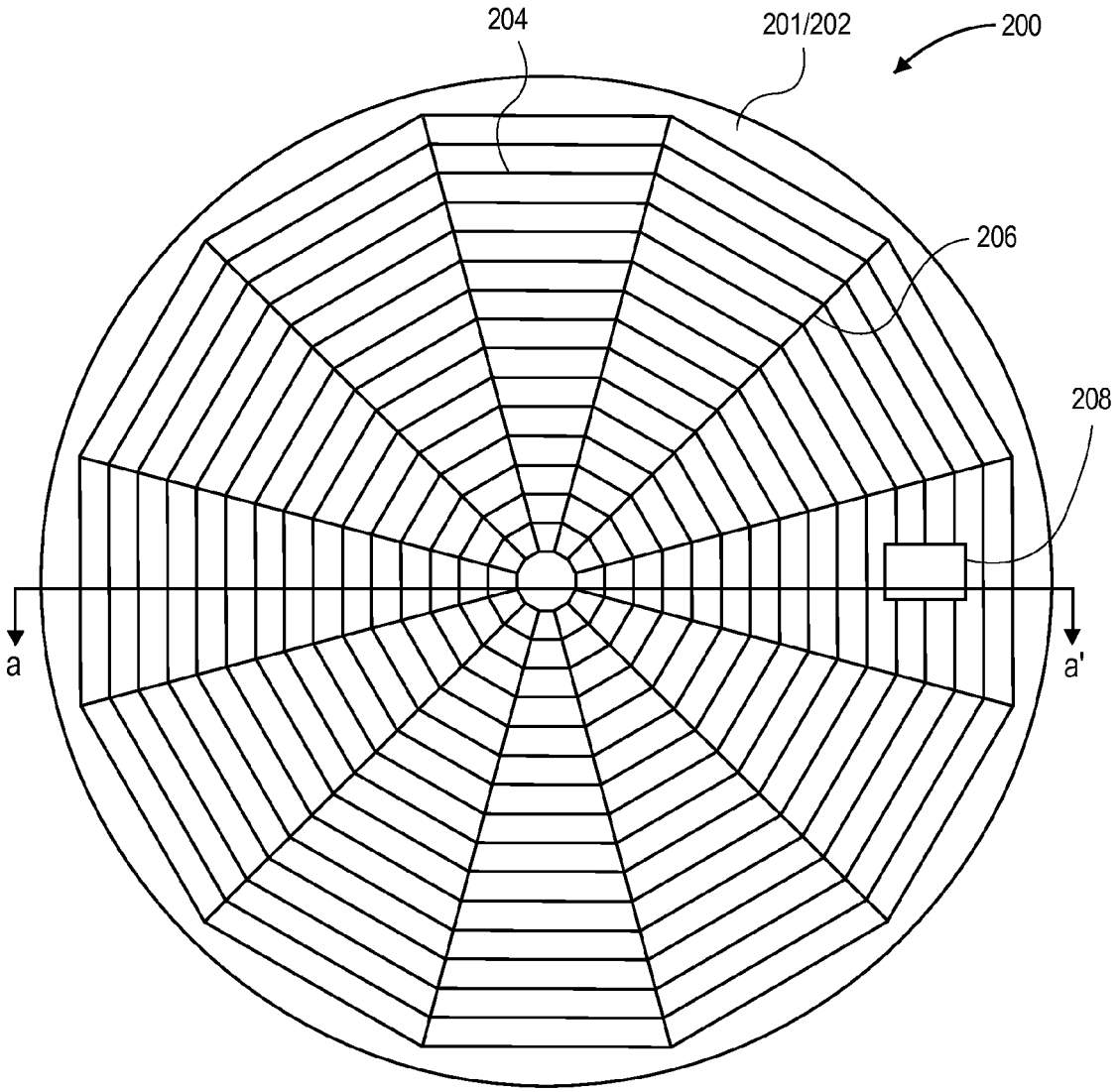
FIG. 2 illustrates a top-down plan view of a polishing pad with an aperture or opening in the polishing surface layer, in accordance with an embodiment of the present invention.

Referring to FIG. 2, a polishing apparatus 200 for polishing a substrate includes a polishing pad 201. The polishing pad 201 has a polishing surface 202 and a back surface (not shown). The polishing surface 202 includes a pattern of grooves, such as circumferential groove 204 and radial groove 206. It is to be appreciated that the polishing surface 202 may have any pattern of grooves suitable for a chemical mechanical polishing process. For example, referring to FIG. 2, the polishing surface 202 has a pattern of grooves of concentric polygons (as opposed to concentric circles as shown in FIG. 1) with radial grooves. That is, the circumferential grooves 204 form concentric polygons with radial groove 206 running through the vertexes thereof. For example, in a specific embodiment, the pattern of grooves of concentric polygons is a pattern of grooves of concentric dodecagons, as depicted in FIG. 2.

An aperture or opening 208 is disposed in the polishing surface 202. In an embodiment, there is no material disposed in the aperture or opening 208, e.g., there is no plug, insert or LAT region in the location of aperture or opening 208. Variations of possible embodiments of the polishing pad of FIG. 2 are described below in association with FIGS. 3A-3C, 4, 5, 6A and 6B.

A polishing pad may be provided with a continuous polishing surface layer having an aperture formed therein. For example, FIGS. 3A-3C illustrate cross-sectional views, as taken along the a-a' axis of FIG. 2, of polishing pads with a transparent foundation layer and a continuous polishing surface layer having an aperture disposed therein, in accordance with embodiments of the present invention.

Figures 3A, 3B, 3C:
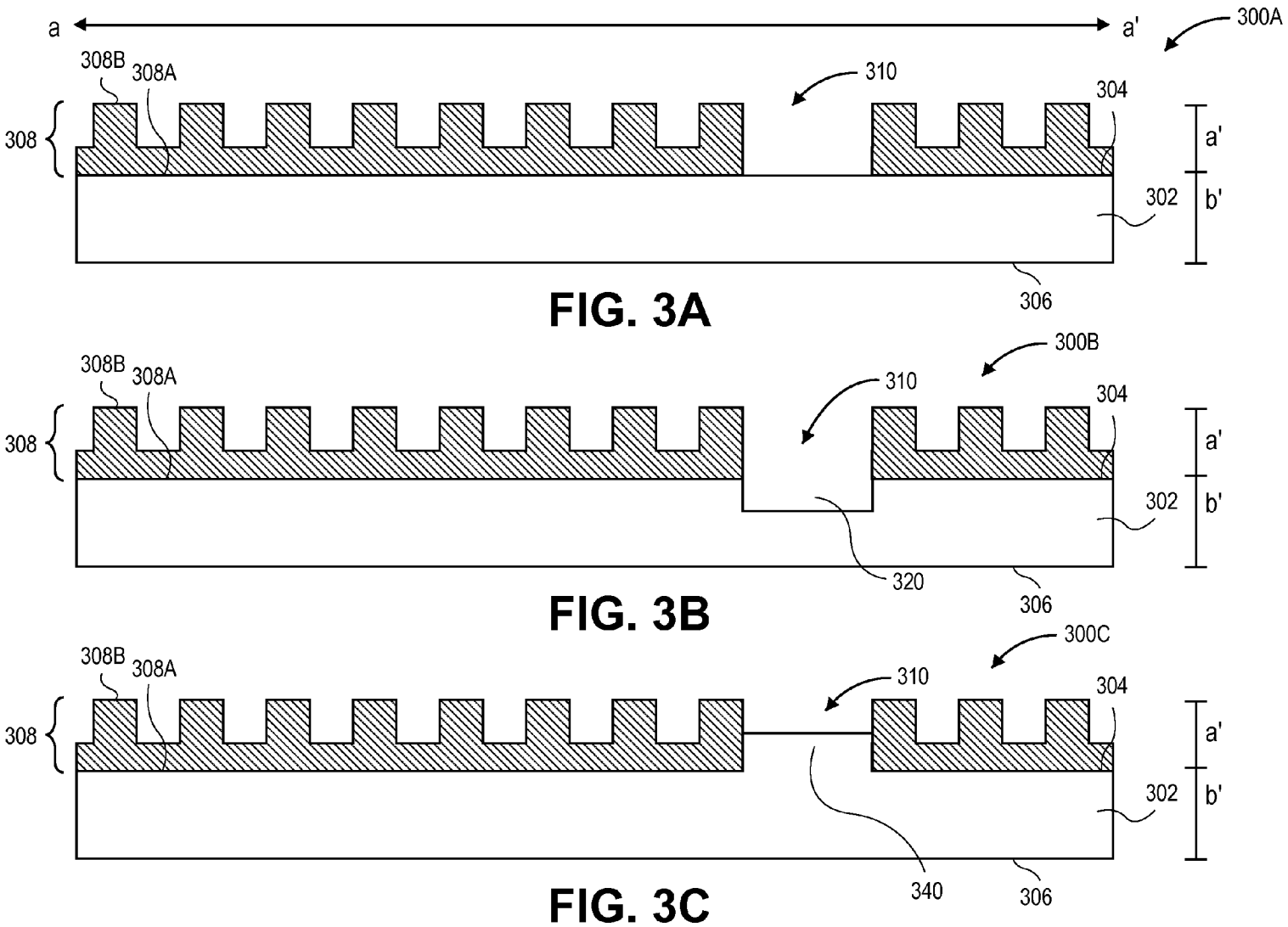
FIGS. 3A-3C illustrate cross-sectional views, as taken along the a-a' axis of FIG. 2, of polishing pads with a transparent foundation layer and a continuous polishing surface layer having an aperture disposed therein, in accordance with embodiments of the present invention.

Referring to FIGS. 3A-3C, examples of polishing pads 300A, 300B and 300C, respectively, are provided for polishing a substrate. The polishing pads 300A, 300B and 300C include a transparent foundation layer 302 having a global top surface 304 and a back side 306. A polishing surface layer 308 is attached to the global top surface 304 of the transparent foundation layer 302. The polishing surface layer 308 has a polishing surface 308B and a back surface 308A. An aperture 310 is disposed in the polishing pad from the back surface 308A through to the polishing surface 308B of the polishing surface layer 308. In an embodiment, the transparent foundation layer 306 provides an impermeable seal for the aperture 310 at the back surface 308B of the polishing surface layer 308. In an embodiment, the polishing surface layer 308 includes a continuous layer portion with a plurality of polishing features protruding there from, as depicted in FIGS. 3A-3C. It is the continuous layer portion of the polishing surface layer 308 that is attached to the transparent foundation layer 302.

Referring to FIG. 3A specifically, in one embodiment, the aperture 310 is disposed over the global top surface 304 of the transparent foundation layer 302. Referring to FIG. 3B specifically, in one embodiment, the aperture 310 is disposed over an opening 320 formed in the transparent foundation layer 302. The bottom of the opening 320 is below the global top surface 304 of the transparent foundation layer 302. Referring to FIG. 3C specifically, in one embodiment, the aperture 310 is disposed over a protrusion 340 formed from the transparent foundation layer 302. The top of the protrusion 340 is above the global top surface 304 of the transparent foundation layer 302 and located within the aperture 310 of the polishing surface layer 308.

In another aspect, a polishing pad may be provided with a discontinuous polishing surface layer having an aperture formed therein. For example, FIG. 4 illustrates a cross-sectional view, as taken along the a-a' axis of FIG. 2, of a polishing pad with a transparent foundation layer and a discontinuous polishing surface layer having an aperture disposed therein, in accordance with embodiments of the present invention.

Figure 4:
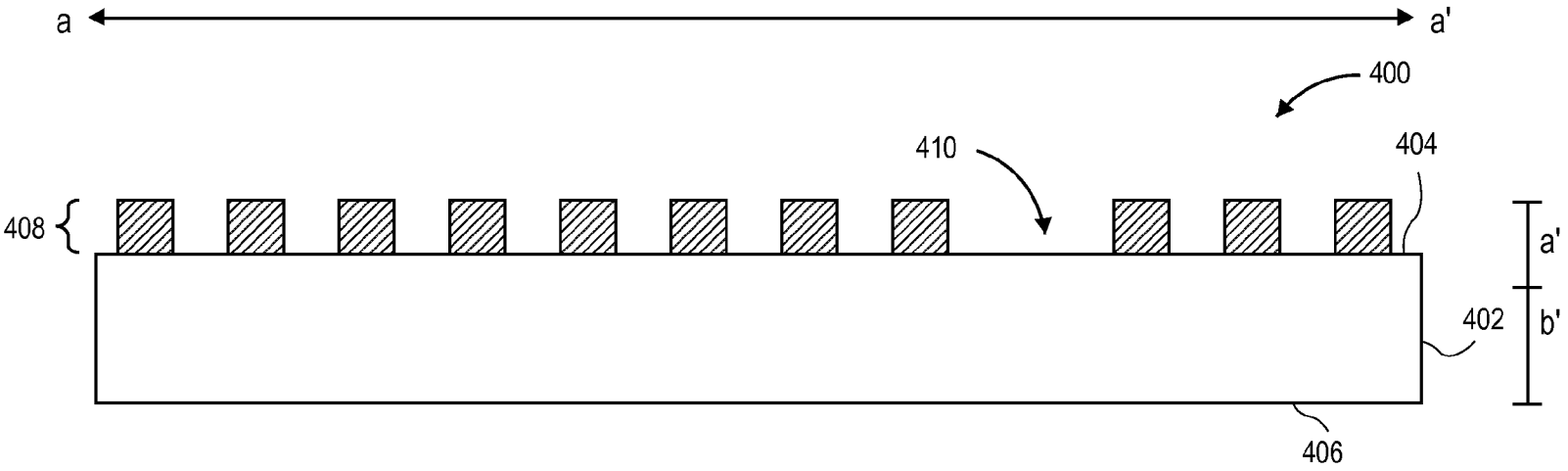
FIG. 4 illustrates a cross-sectional view, as taken along the a-a' axis of FIG. 2, of a polishing pad with a transparent foundation layer and a discontinuous polishing surface layer having an aperture disposed therein, in accordance with embodiments of the present invention.

Referring to FIG. 4, an example of a polishing pad 400 is provided for polishing a substrate. The polishing pad 400 includes a transparent foundation layer 402 having a global top surface 404 and a back side 406. A polishing surface layer 408 is attached to the global top surface 404 of the transparent foundation layer 402. An aperture 410 is disposed in the polishing pad, e.g., by interrupting the pattern of polishing features of the polishing surface layer 408. In an embodiment, the transparent foundation layer 406 provides an impermeable seal for the aperture 410 of the polishing surface layer 408. In an embodiment, the polishing surface layer 408 is a plurality of polishing features protruding from the surface 404, as depicted in FIG. 4. It is the protrusions of the discontinuous layer portion of the polishing surface layer 408 that is attached to the transparent foundation layer 402.

In an embodiment, the above described polishing pads are suitable for use with an end-point detection system. For example, end-point detection may be performed through the transparent foundation layer in conjunction with an aperture formed in an overlying polishing surface layer. Thus, in an embodiment, a transparent foundation layer is substantially transparent to light such as, but not limited to, visible light, ultra-violet light, infra-red light, or a combination thereof. However, it may be the case that the foundation layer cannot or need not be fabricated to be perfectly transparent, but may still be effective for transmission of light for end-point detection. In one such embodiment, a transparent foundation layer transmits as little as approximately 80% of incident light in the 700-710 nanometer range, but is still suitable to act as a portion of a detection region within a polishing pad. In another embodiment, however, a transparent foundation layer transmits as approximately 80% or more of incident light in the 700-710 nanometer range. In an embodiment, a transparent foundation layer is effectively transparent (e.g., ideally totally transparent) for transmission of light for end-point detection.

In another aspect, a polishing pad may be provided with a continuous polishing surface layer having an opening formed therein. For example, FIG. 5 illustrates a cross-sectional view, as taken along the a-a' axis of FIG. 2, of a polishing pad with a transparent foundation layer and a continuous polishing surface layer having an opening disposed therein, in accordance with embodiments of the present invention.

Figure 5:
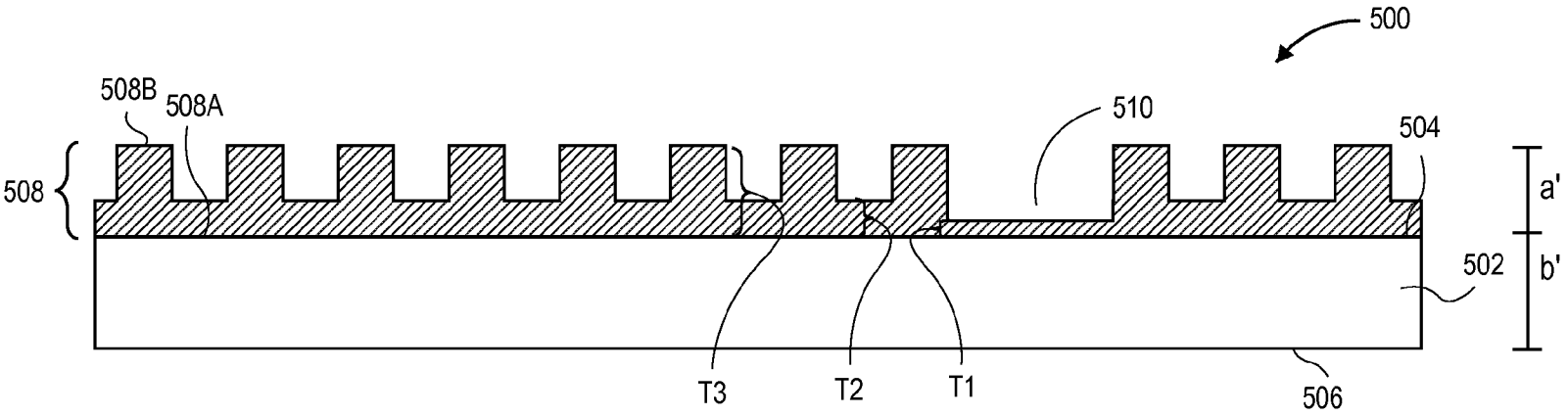
FIG. 5 illustrates a cross-sectional view, as taken along the a-a' axis of FIG. 2, of a polishing pad with a transparent foundation layer and a continuous polishing surface layer having an opening disposed therein, in accordance with embodiments of the present invention.

Referring to FIG. 5, an example of a polishing pad 500 is provided for polishing a substrate. The polishing pad 500 includes a transparent foundation layer 502 having a global top surface 504 and a back side 506. A polishing surface layer 508 is attached to the global top surface 504 of the transparent foundation layer 502. The polishing surface layer 508 has a polishing surface 508B and a back surface 508A. An opening 510 is disposed in the polishing pad from the polishing surface 508B, but not through to the back surface 508A, of the polishing surface layer 508.

In an embodiment, the polishing surface layer 508 includes a continuous layer portion with a plurality of polishing features protruding there from, as depicted in FIG. 5. It is the continuous layer portion of the polishing surface layer 508 that is attached to the transparent foundation layer 502. The total thickness (T3) of the polishing surface layer 508 is thus greater than the height of the protrusions by an amount (T2). In one embodiment, the amount T2 is greater than the thickness (T1) of portion of the polishing surface layer 508 that remains at the bottom of the opening 510, as depicted in FIG. 5. In another embodiment, however, the amount T2 is approximately the same as the thickness (T1) of portion of the polishing surface layer 508 that remains at the bottom of the opening 510. In yet another embodiment, the amount T2 is less than the thickness (T1) of portion of the polishing surface layer 508 that remains at the bottom of the opening 510.

Referring again to FIG. 5, in one embodiment, the opening 510 is disposed over the global top surface 504 of the transparent foundation layer 502. The arrangement is similar to the embodiment described in association with FIG. 3A, with the exception that a portion of the polishing surface layer 508 remains at the bottom of the opening 510. However, in another embodiment (not shown), the opening of the polishing surface layer is disposed over an opening formed in the transparent foundation layer. The bottom of the opening of the transparent foundation layer is below the global top surface of the transparent foundation layer. The arrangement is similar to the embodiment described in association with FIG. 3B, with the exception that a portion of the polishing surface layer remains at the bottom of the opening of the transparent foundation layer, e.g., is conformal with the bottom of the opening of the transparent foundation layer. In yet another embodiment (not shown), the opening of the polishing surface layer is disposed over a protrusion formed from the transparent foundation layer. The top of the protrusion is above the global top surface of the transparent foundation layer. The arrangement is similar to the embodiment described in association with FIG. 3C, with the exception that a portion of the polishing surface layer remains at the top of the protrusion of the transparent foundation layer, e.g., is conformal with the top of the protrusion of the transparent foundation layer.

As described in greater detail below, the polishing surface layer 508 may be opaque. Nonetheless, the thickness T1 may be sufficiently thin to allow at least some transmission of light, e.g., for an end-point detection process. For example, in an embodiment, the combination of the transparent foundation layer 502 and the portion of the back surface 508A of the polishing surface layer 508 underneath the opening 510 (e.g., the region having thickness T1) is substantially transparent to light such as, but not limited to, visible light, ultra-violet light, infra-red light, or a combination thereof. In one such embodiment, the combination of the transparent foundation layer 502 and the portion of the back surface 508A of the polishing surface layer 508 underneath the opening 510 transmits approximately 80% or more of incident light in the 700-710 nanometer range. In an embodiment, the combination of the transparent foundation layer 502 and the portion of the back surface 508A of the polishing surface layer 508 underneath the opening 510 is effectively transparent for transmission of light for end-point detection.

Figure 6:
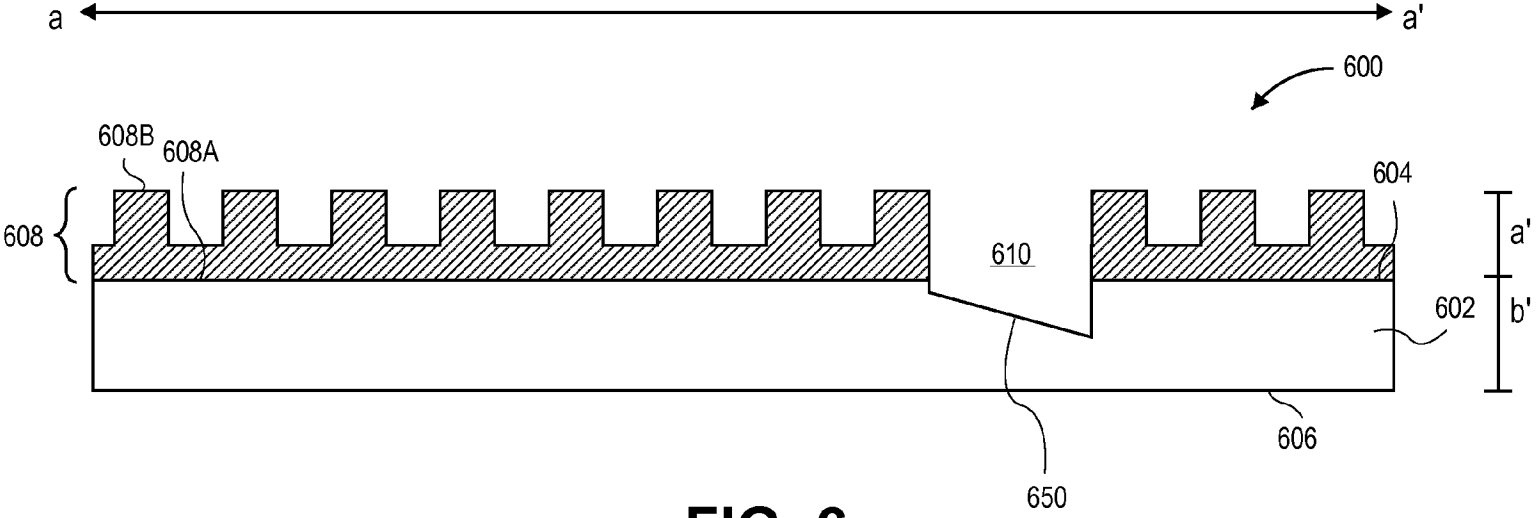
FIG. 6 illustrates a cross-sectional view, as taken along the a-a' axis of FIG. 2, of a polishing pad with a slurry deflection system formed in a transparent foundation layer and a continuous polishing surface layer having an aperture disposed there over, in accordance with embodiments of the present invention.

In another aspect, a slurry deflection system is included in a transparent foundation layer or in a polishing surface layer disposed on a transparent foundation layer. In a first example, FIG. 6 illustrates a cross-sectional view, as taken along the a-a' axis of FIG. 2, of a polishing pad with a slurry deflection system formed in a transparent foundation layer and a continuous polishing surface layer having an aperture disposed there over, in accordance with embodiments of the present invention. It is to be understood that end-point detection may still be performed through features including such slurry deflection systems.

Referring to FIG. 6, an example of a polishing pad 600 is provided for polishing a substrate. The polishing pad 600 includes a transparent foundation layer 602 having a global top surface 604 and a back side 606. A polishing surface layer 608 is attached to the global top surface 604 of the transparent foundation layer 602. The polishing surface layer 608 has a polishing surface 608B and a back surface 608A. An aperture 610 is disposed in the polishing pad from the back surface 608A through to the polishing surface 608B of the polishing surface layer 608. In an embodiment, the transparent foundation layer 606 provides an impermeable seal for the aperture 610 at the back surface 608B of the polishing surface layer 308. In an embodiment, the polishing surface layer 608 includes a continuous layer portion with a plurality of polishing features protruding there from, as depicted in FIG. 6. It is the continuous layer portion of the polishing surface layer 608 that is attached to the transparent foundation layer 602. In an embodiment, a slurry deflection feature 650 is formed in the transparent foundation layer 602 and recessed below the global top surface 604 of the transparent foundation layer 602. In one such embodiment, the aperture 610 of the polishing surface layer 608 is disposed over, e.g., aligned with, the slurry deflection feature 650 of the transparent foundation layer 602, as depicted in FIG. 6. In an alternative embodiment (not shown), only an opening is formed in polishing surface layer 608, as opposed to aperture 610. In one such alternative embodiment, the polishing surface layer 608 is entirely continuous and includes a portion of material conformal with the slurry deflection feature 650 of the transparent foundation layer 602.

Figure 7:
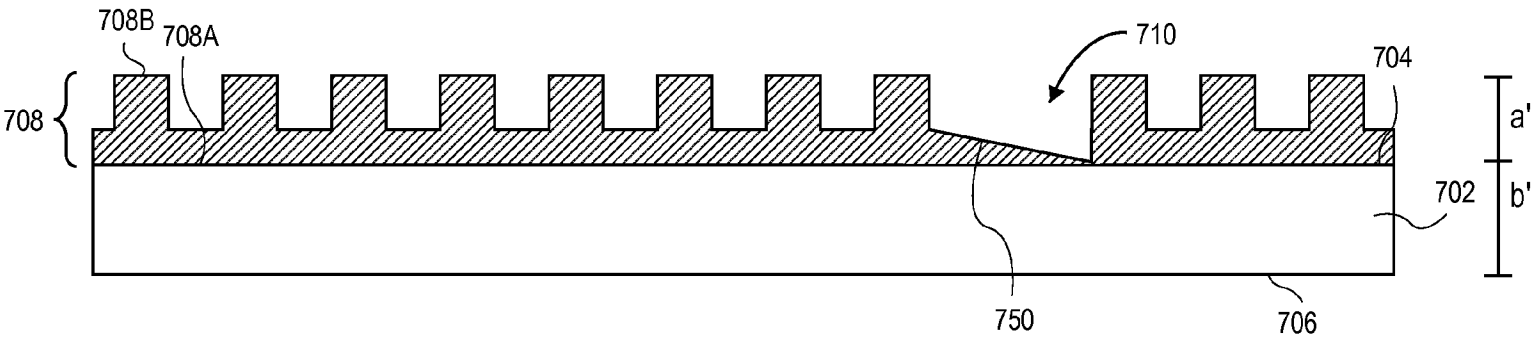
FIG. 7 illustrates a cross-sectional view, as taken along the a-a' axis of FIG. 2, of a polishing pad with a transparent foundation layer and a continuous polishing surface layer having a slurry deflection system disposed therein, in accordance with embodiments of the present invention.

In a second example, FIG. 7 illustrates a cross-sectional view, as taken along the a-a' axis of FIG. 2, of a polishing pad with a transparent foundation layer and a continuous polishing surface layer having a slurry deflection system disposed therein, in accordance with embodiments of the present invention.

Referring to FIG. 7, an example of a polishing pad 700 is provided for polishing a substrate. The polishing pad 700 includes a transparent foundation layer 702 having a global top surface 704 and a back side 706. A polishing surface layer 708 is attached to the global top surface 704 of the transparent foundation layer 702. The polishing surface layer 708 has a polishing surface 708B and a back surface 708A. An opening 710 is disposed in the polishing pad from the polishing surface 708B, but not through to the back surface 708A, of the polishing surface layer 708. In an embodiment, a slurry deflection feature 750 is formed in opening 710 of the polishing surface layer 708, as depicted in FIG. 7.

In an embodiment, a slurry deflection system includes use of a geometry in a polishing surface layer, in a transparent foundation layer, or both, suitable to allow flushing of slurry from the aperture during a chemical mechanical polishing operation. Although only two examples of such deflections systems are illustrated in FIGS. 6 and 7, any geometry for an aperture or opening suitable for slurry flushing is considered within the spirit and scope of embodiments of the present invention. As an example, modifications of a wedge or ramp shape of one or more edges of an aperture or opening may facilitate slurry flow out of the opening or the aperture. Examples of geometries of slurry deflections systems suitable for use with openings and apertures described herein are disclosed in U.S. patent application Ser. No. 13/184,395 filed on Jul. 15, 2011, assigned to NexPlanar Corporation, which is incorporated by reference herein.

The polishing surface layers of the above described polishing pads 200, 300A, 300B, 300C, 400, 500, 600 and 700 are described as being attached to the corresponding transparent foundation layer. In an embodiment, the polishing surface layers are "bonded with" the corresponding transparent foundation layers. In a first such embodiment, the polishing surface layers are bonded directly to the corresponding transparent foundation layers. That is, the polishing surface layers are in direct contact with the corresponding transparent foundation layers. In one embodiment, then, "bonded directly to" describes direct contact with no intervening layers (such as pressure sensitive adhesive layers) or otherwise glue-like or adhesive films. It may be preferable that the polishing surface layers are bonded directly to the corresponding transparent foundation layers so that only the polishing surface layer and corresponding transparent foundation layer dictate the polishing performance of a pad composed there of. In another embodiment, attached is used to mean the use of intervening layers (such as pressure sensitive adhesive layers) or otherwise glue-like or adhesive films. Other intervening films or layers may also be included.

In a specific such embodiment, a polishing surface layer is covalently bonded to the corresponding transparent foundation layer. In an embodiment, the term "covalently bonded" refers to arrangements where atoms from a first material (e.g., the material of a polishing surface layer) are cross-linked or share electrons with atoms from a second material (e.g., the material of a foundation layer) to effect actual chemical bonding. Covalent bonding is distinguished from mechanical bonding, such as bonding through screws, nails, glues, or other adhesives. In another specific embodiment, a polishing surface layer is not covalently bonded, but is rather only electrostatically bonded, to the corresponding transparent foundation layer. Such electrostatic bonding may involve van der Waals type interactions between the transparent foundation layer and the polishing surface layer.

Peel resistance may provide an indication of the strength and extent to which a polishing surface layer is bonded with a transparent foundation layer. In an embodiment, a transparent foundation layer and the corresponding polishing surface layer have a peel resistance sufficient to withstand a shear force applied during the useful lifetime of the polishing pad.

In an embodiment, a surface roughness is used at the interface of a polishing surface layer and a transparent foundation layer to enhance bond strength of these two portions of a polishing pad. In one such embodiment, the transparent foundation layer has a surface roughness greater than approximately 1 micrometer Ra (root mean square) where a corresponding polishing surface layer is bonded directly to the transparent foundation layer. In a specific such embodiment, the surface roughness is approximately in the range of 5-10 micrometers Ra (root mean square).

However, in another embodiment, substantial surface roughness is not included and the interface of a polishing surface layer and a transparent foundation layer is particularly smooth. The strength of such a smooth interface may be independent of surface roughness or may not need further strengthening by the inclusion of such surface roughness. In one such embodiment, a transparent foundation layer has a smooth surface with a surface roughness less than approximately 1 micrometer Ra (root mean square) where a corresponding polishing surface layer is bonded directly to the transparent foundation layer. The decision or need to include or exclude roughness at an interface of a transparent foundation layer and a polishing surface layer may depend on the pristine nature of the interface (e.g., exclusion of impurities such as oil films) or on the nature of the materials at the interface. For example, in a particular such embodiment, a polishing surface layer at a smooth interface is composed of a material formed from polyurethane.

The materials of the polishing surface layers and corresponding transparent foundation layer of the above described polishing pads 200, 300A, 300B, 300C, 400, 500, 600 and 700 may each have defined parameters suitable to provide desired polishing characteristics, either as individual components or collectively for the polishing pad as an entirety. For example, in one such embodiment a polishing surface layer and corresponding transparent foundation layer differ in their energy loss factor, or KEL. KEL is parameter for predicting polishing performance. ASTM D4092-90 ("Standard Terminology Relating to Dynamic Mechanical Measurements of Plastics") defines this parameter as the energy per unit volume lost in each deformation cycle. In other words, it is a measure of the area within the stress-strain hysteresis loop. The Energy Loss Factor (KEL) is a function of both tan δ and the elastic storage modulus (E') and may be defined by the following equation: $KEL=\tan\delta*10^{12}/[E'*(1+\tan\delta^2)]$ where E' is in Pascals. The ratio of elastic stress to strain is the storage (or elastic) modulus and the ratio of the viscous stress to strain is the loss (or viscous) modulus. When testing is performed in tension, flex, or compression, E' and E" designate the storage and loss modulus, respectively. The ratio of the loss modulus to the storage modulus is the tangent of the phase angle shift (δ) between the stress and the strain. Thus, E"/E'=tan δ and is a measure of the damping ability of the material. In an embodiment, a transparent foundation layer has an energy loss factor of less than approximately 100 KEL at 1/Pa at 40° C., e.g., of approximately 7. In an embodiment, a polishing surface layer has an energy loss factor of greater than approximately 1000 KEL at 1/Pa at 40° C., e.g., of approximately 8000. In an embodiment, a transparent foundation layer has an energy loss factor of less than approximately 100 KEL at 1/Pa at 40° C., the corresponding polishing surface layer has an energy loss factor of greater than approximately 1000 KEL at 1/Pa at 40° C., and the transparent foundation layer and the corresponding polishing surface layer together have an energy loss factor of less than approximately 100 KEL at 1/Pa at 40° C.

The materials of the polishing surface layer and corresponding transparent foundation layer of the above described polishing pads 200, 300A, 300B, 300C, 400, 500, 600 and 700 may each have defined compressibility of elasticity suitable to provide desired polishing characteristics, either as individual components or collectively for the polishing pad as an entirety. In an embodiment, a transparent foundation layer has a compressibility of less than approximately 1% under an applied pressure of 5 PSI. In an embodiment, a polishing surface layer has a compressibility of greater than approximately 0.1% under an applied pressure of 5 PSI. In an embodiment, a polishing surface layer has a first modulus of elasticity, and the corresponding transparent foundation layer has a second modulus of elasticity greater than approximately 5 times, and even 10 times, the first modulus of elasticity, e.g. for a relatively harder polishing surface on a hard foundation layer. In another embodiment, however, a polishing surface layer has a first modulus of elasticity, and the corresponding transparent foundation layer has a second modulus of elasticity greater than approximately 100 times the first modulus of elasticity, e.g. for a relatively softer polishing surface on a hard transparent foundation layer.

In another example, the materials of the polishing surface layer and corresponding transparent foundation layer of the above described polishing pads 200, 300A, 300B, 300C, 400, 500, 600 and 700 may each have defined hardness suitable to provide desired polishing characteristics, either as individual components or collectively for the polishing pad as an entirety. In an embodiment, a transparent foundation layer has a hardness greater than approximately 75 Shore D, e.g., approximately 84-85 Shore D for a polycarbonate transparent foundation layer. In an embodiment, a polishing surface layer has a hardness less than approximately 70 Shore D and, preferably, less than approximately 60 Shore D. In an embodiment, a transparent foundation layer has a hardness approximately in the range of 70-90 Shore D, and the corresponding polishing surface layer has a hardness approximately in the range of 50-60 Shore D, e.g., for a hard polyurethane polishing surface layer. In another embodiment, a transparent foundation layer has a hardness approximately in the range of 70-90 Shore D, and the corresponding polishing surface layer has a hardness approximately in the range of 20-50 Shore D, e.g., for a soft polyurethane polishing surface layer.

The materials of the polishing surface layers and corresponding transparent foundation layers of the above described polishing pads 200, 300A, 300B, 300C, 400, 500, 600 and 700 may each have defined composition suitable to provide desired polishing characteristics, either as individual components or collectively for the polishing pad as an entirety. In an embodiment, a transparent foundation layer is composed of a polycarbonate material. In one such embodiment, the polycarbonate material is composed of a stack of several discrete layers (sub layers) of polycarbonate or is composed of a single, continuous, layer of polycarbonate. In another embodiment, a transparent foundation layer is composed of a material such as, but not limited to, an epoxy board material.

In an embodiment, a polishing surface layer of the above described polishing pads 200, 300A, 300B, 300C, 400, 500, 600 and 700 is a homogeneous polishing surface layer. In one such embodiment, the homogeneous polishing surface layer is composed of a thermoset polyurethane material. For example, in a specific embodiment, the homogeneous body is composed of a thermoset, closed cell polyurethane material. In an embodiment, the term "homogeneous" is used to indicate that the composition of a thermoset, closed cell polyurethane material is consistent throughout the entire composition of the body. For example, in an embodiment, the term "homogeneous" excludes polishing pad bodies composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance. In an embodiment, although a polishing surface layer is composed of a thermoset material, the corresponding transparent foundation layer is composed of a thermoplastic material, such as a polycarbonate.

The materials of the polishing surface layers of the above described polishing pads 200, 300A, 300B, 300C, 400, 500, 600 and 700 may be molded. The term "molded" may be used to indicate that the polishing surface layer is formed in a formation mold, as described in more detail below in association with FIGS. 10A-10F. In an embodiment, a molded polishing surface layer, upon conditioning and/or polishing, has a polishing surface roughness approximately in the range of 1-5 microns root mean square. In one embodiment, a molded polishing surface layer, upon conditioning and/or polishing, has a polishing surface roughness of approximately 2.35 microns root mean square. In an embodiment, a molded polishing surface layer has a storage modulus at 25 degrees Celsius approximately in the range of 30-500 megaPascals (MPa). In another embodiment, a molded polishing surface layer has a storage modulus at 25 degrees Celsius approximately less than 30 megaPascals (MPa).

The materials of a polishing surface layer of the above described polishing pads 200, 300A, 300B, 300C, 400, 500, 600 and 700 may include pore-forming features. In an embodiment, a polishing surface layer has a pore density of closed cell pores approximately in the range of 6%-50% total void volume. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a polishing surface layer of a polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing surface layer. In an embodiment, although a polishing surface layer includes pore-forming features, the corresponding transparent foundation layer does not and is non-porous.

In an embodiment, polishing pads described herein, such as polishing pads 200, 300A, 300B, 300C, 400, 500, 600 and 700, include a polishing surface layer that is opaque. In one embodiment, the term "opaque" is used to indicate a material that, in its bulk form, allows approximately 10% or less visible light to pass. In one embodiment, a polishing surface layer is opaque in most part, or due entirely to, the inclusion of an opacifying particle filler, such as a lubricant, throughout (e.g., as an additional component in) the polishing surface layer. In a specific embodiment, the opacifying particle filler is a material such as, but not limited to boron nitride, cerium fluoride, graphite, graphite fluoride, molybdenum sulfide, niobium sulfide, talc, tantalum sulfide, tungsten disulfide, or Teflon®.

In another example, the materials of the polishing surface layers of the above described polishing pads 200, 300A, 300B, 300C, 400, 500, 600 and 700 and corresponding transparent foundation layers may each have defined dimensions suitable to provide desired polishing characteristics, either as individual components or collectively for the polishing pad as an entirety. In an embodiment, a polishing surface layer has a thickness (a' in FIG. 3A, 3B, 3C, 4, 5, 6 or 7) approximately in the range of 2-50 mils, and the corresponding transparent foundation layer has a thickness (b') of greater than approximately 20 mils. In a particular embodiment, a polishing surface layer has a thickness approximately in the range of 10-30 mils and a groove depth approximately in the range of 50-100% of the thickness of the polishing surface layer, and a corresponding transparent foundation layer has a thickness approximately in the range of 40-80 mils. In another particular embodiment, a polishing surface layer has a thickness of approximately 15 mils and a groove depth of approximately 10 mils, and a corresponding transparent foundation layer has a thickness of approximately 60 mils.

In an embodiment, the thickness (b') of the transparent foundation layer is greater than the thickness (a') of the corresponding polishing surface layer. In an embodiment, the transparent foundation layer has a thickness (b') and hardness relative to the thickness (a') and hardness of the corresponding polishing surface layer sufficient to dictate the bulk polishing characteristics of the corresponding polishing pad. In an embodiment, the transparent foundation layer is sufficiently thick for the corresponding polishing pad to provide die-level polishing planarity, but sufficiently thin for the polishing pad to provide wafer-level polishing uniformity.

Although the above embodiments primarily focus on polishing pads with a polishing surface layer softer than a corresponding, underlying, transparent foundation layer, other arrangements are contemplated within the spirit and scope of embodiments of the present invention. For example, in an embodiment, a polishing pad for polishing a substrate includes a transparent foundation layer having a first hardness. A polishing surface layer is bonded with the transparent foundation layer. The polishing surface layer has a second hardness equal to or greater than the first hardness. In one embodiment, the polishing surface layer is directly bonded to, and is covalently bonded to, the transparent foundation layer. In one embodiment, the transparent foundation layer and the polishing surface layer have a peel resistance sufficient to withstand a shear force applied during the useful lifetime of the polishing pad. In one embodiment, the polishing surface layer is composed of a continuous layer portion with plurality of polishing features protruding there from, the continuous layer portion bonded directly to the transparent foundation layer. In one embodiment, the polishing surface layer is composed of a plurality of discrete polishing protrusions bonded directly to the transparent foundation layer.

In another example, in an embodiment, a polishing pad for polishing a substrate includes a transparent foundation layer having an energy loss factor of less than approximately 100 KEL at 1/Pa at 40° C. A polishing surface layer is bonded with the transparent foundation layer. The polishing surface layer has an energy loss factor of greater than approximately 1000 KEL at 1/Pa at 40° C. The transparent foundation layer and the polishing surface layer together have an energy loss factor of less than approximately 100 KEL at 1/Pa at 40° C. In one embodiment, the polishing surface layer is composed of a continuous layer portion with plurality of polishing features protruding there from, the continuous layer portion attached to the transparent foundation layer. In one embodiment, the polishing surface layer is composed of a plurality of discrete polishing protrusions attached to the transparent foundation layer. In one embodiment, the polishing surface layer is composed of a thermoset polyurethane material.

In another example, in an embodiment, a polishing pad for polishing a substrate includes a transparent foundation layer having a first hardness. A polishing surface layer is bonded with the transparent foundation layer. The polishing surface layer has a second hardness less than the first hardness and is composed of a thermoset material. In one embodiment, the polishing surface layer is a homogeneous polishing surface layer. In one embodiment, the thermoset material is polyurethane. In one embodiment, the transparent foundation layer has a hardness approximately in the range of 70-90 Shore D, and the polishing surface layer has a hardness approximately in the range of 50-60 Shore D. In one embodiment, the transparent foundation layer has a hardness approximately in the range of 70-90 Shore D, and the polishing surface layer has a hardness approximately in the range of 20-50 Shore D. In one embodiment, the polishing surface layer is composed of a continuous layer portion with plurality of polishing features protruding there from, the continuous layer portion attached to the transparent foundation layer. In one embodiment, the polishing surface layer is composed of a plurality of discrete polishing protrusions attached to the transparent foundation layer. In one embodiment, the polishing surface layer has a pore density of closed cell pores approximately in the range of 6%-50% total void volume.

In another example, in an embodiment, a polishing pad for polishing a substrate includes a nonporous transparent foundation layer. A polishing surface layer is bonded with the transparent foundation layer. The polishing surface layer has a pore density of closed cell pores. In one embodiment, the pore density of closed cell pores is approximately in the range of 6%-50% total void volume. In one embodiment, the polishing surface layer is composed of a continuous layer portion with plurality of polishing features protruding there from, the continuous layer portion bonded directly to the transparent foundation layer. In one embodiment, the polishing surface layer is composed of a plurality of discrete polishing protrusions bonded directly to the transparent foundation layer.

The polishing surface layer of the above described polishing pads 200, 300A, 300B, 300C, 400, 500, 600 and 700 may have a pattern suitable for polishing during a CMP operation. Examples are depicted in FIGS. 1 and 2. Further to FIG. 2, basic examples of possible embodiments contemplated for groove patterns having concentric polygons as circumferential grooves, include groove patterns based on a series of grooves that form similar polygons, all with the same center point, and all aligned with an angle theta of zero so that their straight line segments are parallel and their angles are aligned in a radial fashion. Nested triangles, squares, pentagons, hexagons, etc., are all considered within the spirit and scope of the present invention. There may be a maximum number of straight line segments above which the polygons will become approximately circular. Preferred embodiments may include limiting the groove pattern to polygons with a number of sides less than such a number of straight line segments. One reason for this approach may be to improve averaging of the polish benefit, which might otherwise be diminished as the number of sides of each polygon increases and approaches a circular shape. Another embodiment includes groove patterns with concentric polygons having a center that is not in the same location as the polishing pad center. Of course, in other embodiments, an aperture or opening may be formed in a pad with circular circumferential grooves.

Figure 8:
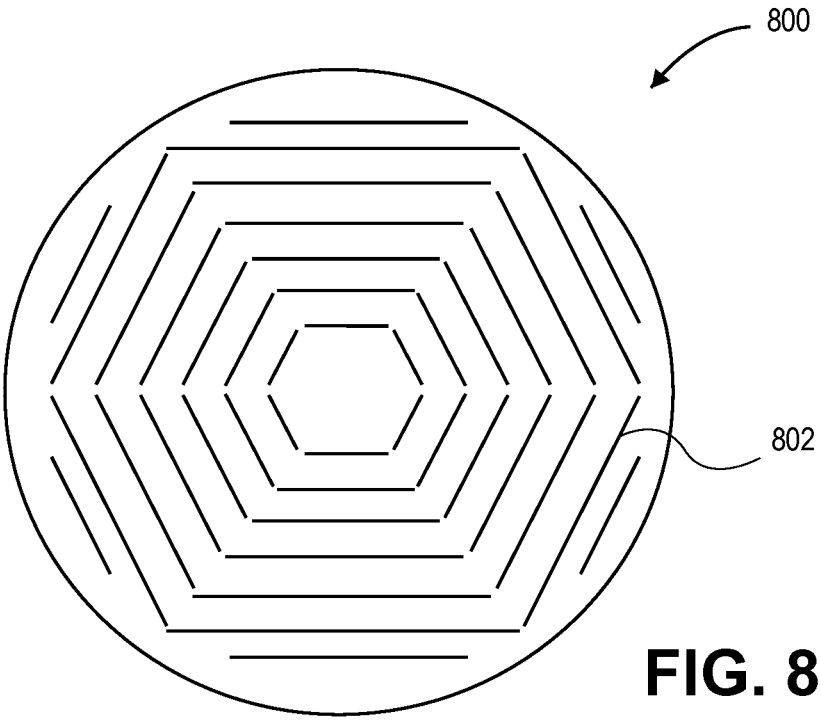
FIG. 8 illustrates a top-down view of a polishing pad with a polishing surface layer including discrete linear segment protrusions, in accordance with an embodiment of the present invention.

In another general example, some embodiments of the present invention include a plurality of protrusions having a pattern of linear features. In a specific such example, FIG. 8 illustrates a top-down view of a polishing pad 800 with a polishing surface layer including discrete linear segment protrusions 802, in accordance with an embodiment of the present invention. The discrete linear segment protrusions shown are essentially orthogonal to radii of the polishing surface. It is to be understood, however, that embodiments of the present invention may also include discrete linear segments that are not precisely orthogonal to radii of the polishing surface. In such embodiments, the discrete linear segments may form a portion of a, but not a complete, concentric or approximately concentric polygon arrangement. The relative association with the corresponding radius is not precisely 90 degrees but rather, perhaps, a fraction of a degree to a few degrees off of 90 degrees. Nonetheless, such near-orthogonal or approximately orthogonal discrete linear segments are considered to be within the spirit and scope of the present invention.

In another general example, some embodiments of the present invention include a plurality of protrusions having a pattern of discrete curved features. In a specific such example, discrete arc-shaped protrusions are included. Other specific such embodiments include, but are not limited to, a plurality of partial circumferential protrusions disposed on a substantially circular polishing pad.

In another general example, some embodiments of the present invention include a plurality of protrusions having a pattern of discrete tiles. In a specific such embodiment, discrete hexagonal tile protrusions are included. Other specific such embodiments include, but are not limited to, pluralities of circular tiles, oval tiles, square tiles, rectangular tiles, or a combination thereof.

Although the above general examples may be defined in terms of protrusions (e.g., the highest points of a patterned polishing surface layer), the polishing surface layers may also or alternatively be defined in terms of grooves (e.g., the lowest points of a patterned polishing surface layer). Individual grooves may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a groove pattern may all have the same depth. In some embodiments, some of the grooves of a groove pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of a groove pattern are all of uniform width. In some embodiments, however, some of the grooves of a groove pattern have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the groove patterns described herein may have a pitch from about 30 to about 1000 mils. In some embodiments, the grooves have a pitch of about 125 mils. For a circular polishing pad, groove pitch is measured along the radius of the circular polishing pad. In CMP belts, groove pitch is measured from the center of the CMP belt to an edge of the CMP belt. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

In another aspect, a polishing pad with a polishing surface layer and corresponding transparent foundation layer further includes a detection region for use with, e.g., an eddy current detection system. For example, FIG. 9 illustrates a top-down plan view of a polishing pad with a polishing surface layer having an aperture or opening along with an indication region, in accordance with an embodiment of the present invention.

Figure 9:
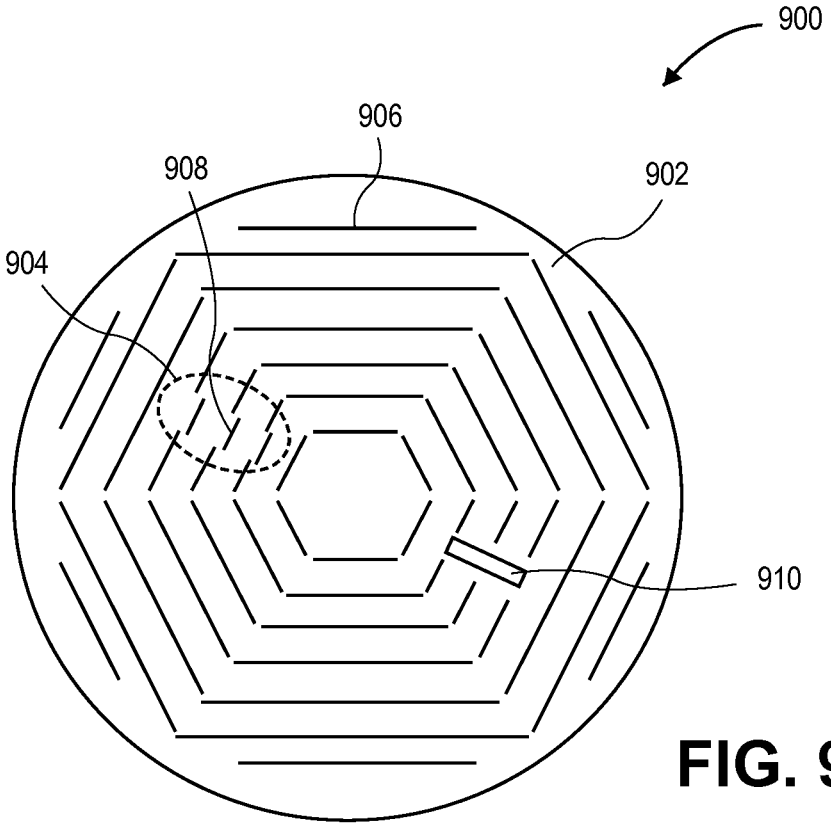
FIG. 9 illustrates a top-down plan view of a polishing pad with a polishing surface layer having an aperture or opening along with an indication region, in accordance with an embodiment of the present invention.

Referring to FIG. 9, the polishing surface layer 902 of polishing pad 900 includes an indication region 904 indicating the location of a detection region disposed in the back surface of the polishing pad 900, e.g., in the back surface of a corresponding foundation layer. In one embodiment, the indication region 904 interrupts a pattern of protrusions or grooves 906 with a second pattern of protrusions or grooves 908, as depicted in FIG. 9. Examples of suitable detection regions, such as eddy current detection regions, are described in U.S. patent application Ser. No. 12/895,465 filed on Sep. 30, 2010, assigned to NexPlanar Corporation. An opening or aperture 910 in the polishing surface layer 902, as contemplated in one or more embodiments described herein, is also depicted as formed in the polishing surface layer 902.

In an embodiment, a polishing pad described above further includes a sub pad, e.g., a conventional sub pad as known in the CMP art. The foundation layer is disposed proximate to the sub pad. In one such embodiment, the sub pad has a hardness less than the hardness of the corresponding foundation layer. In one such embodiment, the sub pad is composed of a material such as, but not limited to, foam, rubber, fiber, felt or a highly porous material. In an embodiment, the sub pad has an aperture. The aperture of the sub pad is aligned with the transparent region of the foundation layer.

In another aspect, polishing pads with transparent foundation layers and corresponding polishing surface layers having an aperture or opening disposed therein may be fabricated in a molding process. For example, such multilayer (e.g., surface polishing layer plus underlying transparent foundation layer) polishing pads as those described above may be fabricated with a molding process to facilitate direct bonding between a surface polishing layer and an underlying foundation layer. FIGS. 10A-10F illustrate cross-sectional views of operations used in the fabrication of a polishing pad with a transparent foundation layer and a polishing surface layer having an aperture or opening disposed therein, in accordance with an embodiment of the present invention.

Figure 10A:
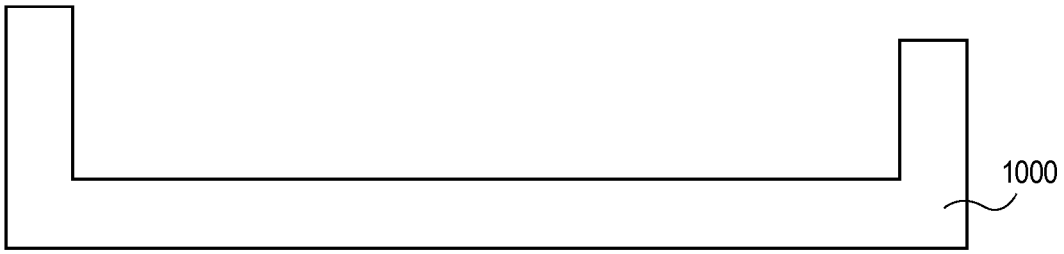
FIGS. 10A-10F illustrate cross-sectional views of operations used in the fabrication of a polishing pad with a transparent foundation layer and a polishing surface layer having an aperture or opening disposed therein, in accordance with an embodiment of the present invention.
Figure 10B:
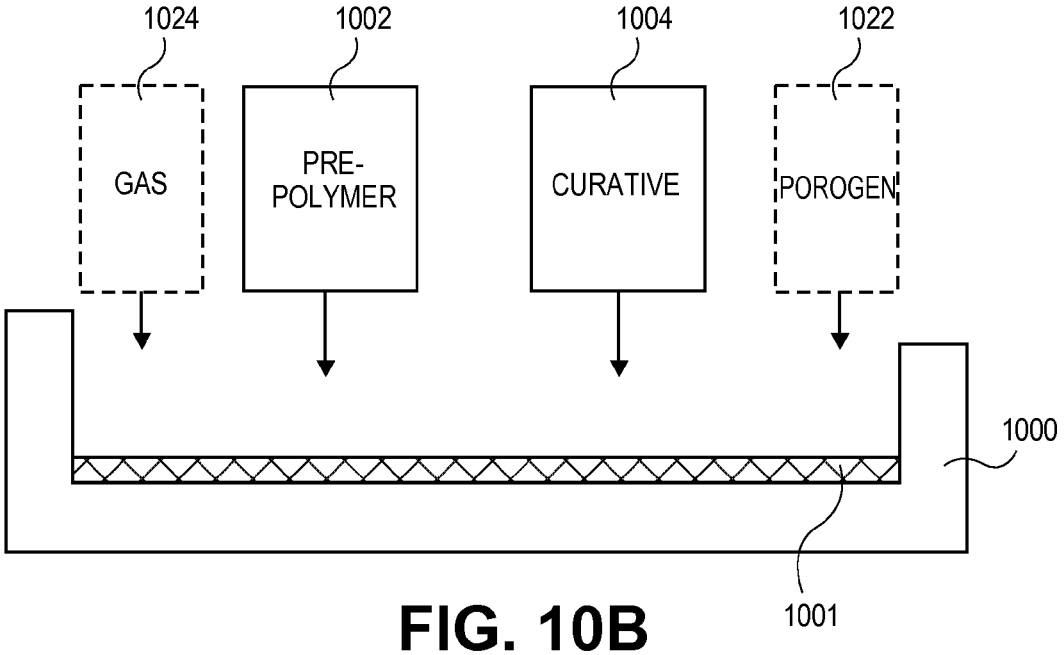

Referring to FIG. 10A, a formation mold 1000 is provided. A transparent foundation layer 1001 is then provided in the formation mold 1000. The transparent foundation layer 1001 may be composed of a material or have properties similar or the same as the materials and properties described above. In an embodiment, the material of transparent foundation layer 1001 is in a completed form, e.g., fully cured, when provided in the formation mold 1000. For example, in an embodiment, the transparent foundation layer 1001 is cut from a larger sheet of the same material and sized for formation mold 1000. In one embodiment, the transparent foundation layer 1001 is placed in a base of the formation mold 1000, as depicted in FIG. 10B. In an embodiment, providing the transparent foundation layer 1001 in the formation mold 1000 includes first roughening a surface of the transparent foundation layer 1001, e.g., roughening the surface upon which a polishing surface layer will ultimately be formed. In one such embodiment, the roughening is performed by a technique such as, but not limited to, plasma treatment, mechanical treatment, or chemical treatment.

Figure 10C:
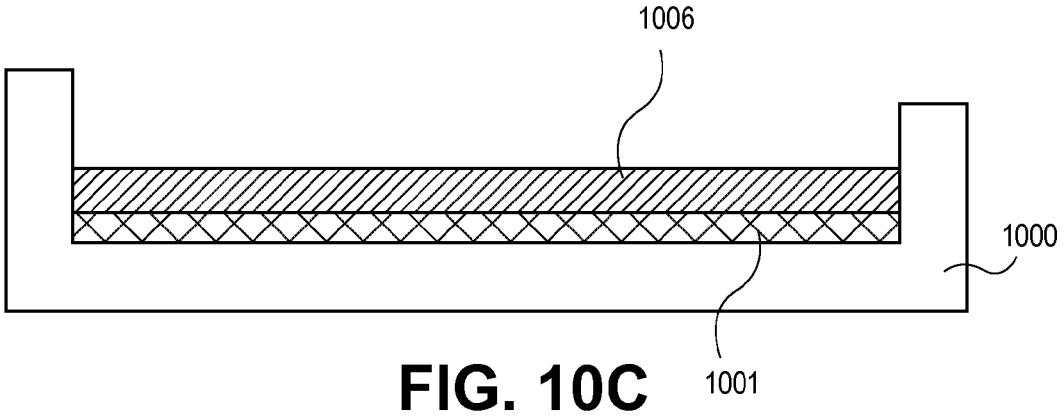

Referring again to FIG. 10B and to FIG. 10C, a set of polymerizable materials such as a pre-polymer 1002 and a curative 1004 are mixed to form a mixture 1006 in the formation mold 1000, on the transparent foundation layer 1001. In an embodiment, mixing the pre-polymer 1002 and the curative 1004 includes mixing an isocyanate and an aromatic diamine compound, respectively. In one embodiment, the mixing further includes adding a particle filler such as an opacifying lubricant to the pre-polymer 1002 and the curative 1004 to ultimately provide an opaque molded homogeneous polishing surface layer of a polishing pad. In a specific embodiment, the opacifying lubricant is a material such as, but not limited to, boron nitride, cerium fluoride, graphite, graphite fluoride, molybdenum sulfide, niobium sulfide, talc, tantalum sulfide, tungsten disulfide, or Teflon.

In an embodiment, the mixture 1006 is used to ultimately form a molded polishing surface layer composed of a thermoset, closed cell polyurethane material. In one embodiment, the mixture 1006 is used to ultimately form a hard polishing surface layer and only a single type of curative is used. In another embodiment, the mixture 1006 is used to ultimately form a soft polishing surface layer and a combination of a primary and a secondary curative is used. For example, in a specific embodiment, the pre-polymer includes a polyurethane precursor, the primary curative includes an aromatic diamine compound, and the secondary curative includes a compound having an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, the pre-polymer, a primary curative, and a secondary curative have an approximate molar ratio of 100 parts pre-polymer, 85 parts primary curative, and 15 parts secondary curative. It is to be understood that variations of the ratio may be used to provide a molded polishing surface layer with varying hardness values, or based on the specific nature of the pre-polymer and the first and second curatives. In an embodiment, mixing the pre-polymer and any curatives to form the mixture 1006 includes degassing the mixture 1006.

Figure 10D:
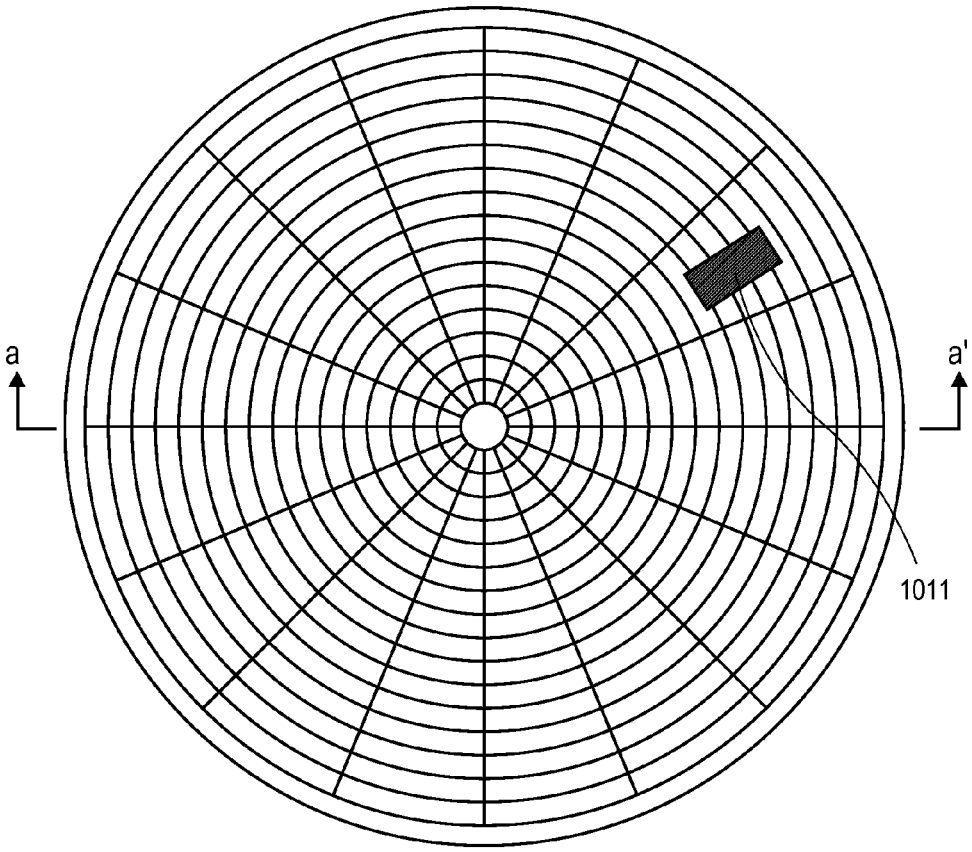
Figure 10D:
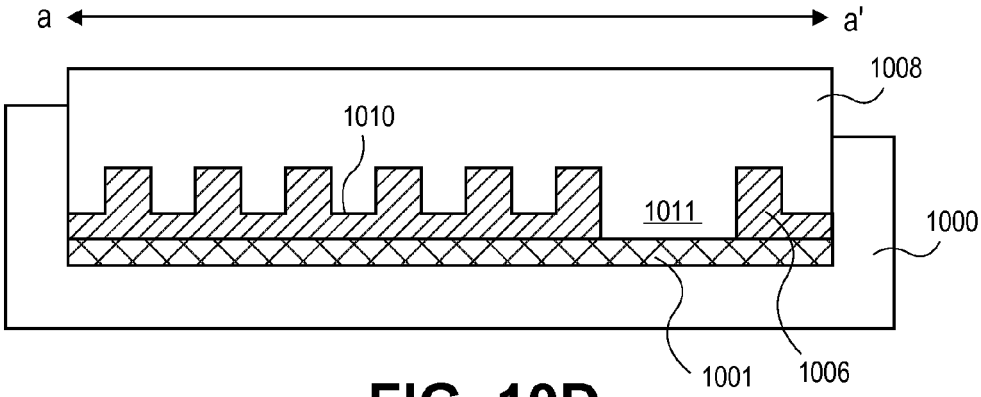

Referring to FIG. 10D, a lid 908 of the formation mold 1000 and the mixture 1006 are moved together, e.g., the lid 1008 is moved into the mixture 1006. A top-down plan view of lid 1008 is shown on top, while a cross-section along the a-a' axis is shown below in FIG. 10D. In an embodiment, the lid 1008 has disposed thereon a pattern of protrusions 1010 and an aperture or opening forming feature 1011. The pattern of protrusions 1010 is used to stamp a pattern of grooves into a polishing surface of a polishing pad formed in formation mold 1000. In an embodiment, the aperture or opening forming feature 1011 is also a protrusion. For example, in one embodiment, the aperture or opening forming feature 1011 is an aperture or opening protrusion having a height greater than the height of the protrusions of the pattern of protrusions 1010.

It is to be understood that embodiments described herein that describe lowering the lid 1008 of a formation mold 1000 need only achieve a bringing together of the lid 1008 and a base of the formation mold 1000. That is, in some embodiments, a base of a formation mold 1000 is raised toward a lid 1008 of a formation mold, while in other embodiments a lid 1008 of a formation mold 1000 is lowered toward a base of the formation mold 1000 at the same time as the base is raised toward the lid 1008.

Figure 10E:
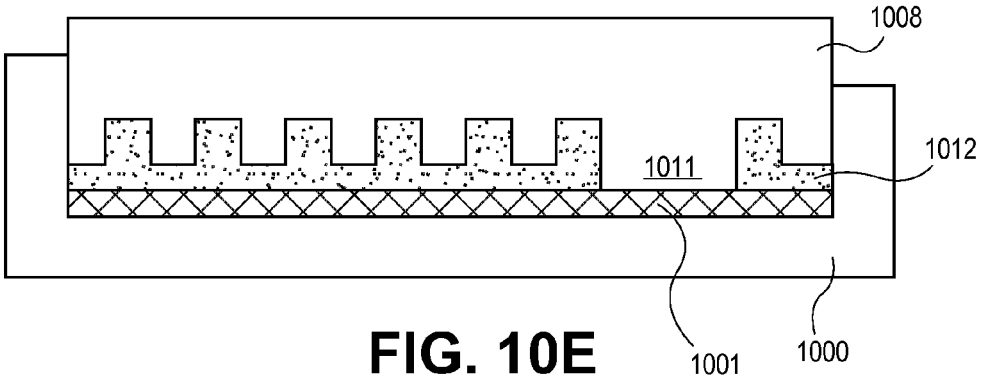

Referring to FIG. 10E, with the lid 1008 placed in the mixture 1006, the mixture 1006 is at least partially cured to provide a molded homogeneous polishing surface layer 1012 in the formation mold 1000. The pattern of protrusions 1010 of the lid 1008 is used to stamp a pattern of grooves in the mixture 1006 above the transparent foundation layer 1001. The mixture 1006 may be heated under pressure (e.g., with the lid 1008 in place) to provide the molded polishing surface layer 1012. In an embodiment, heating in the formation mold 1000 includes at least partially curing in the presence of lid 1008, which encloses mixture 1006 in formation mold 1000, at a temperature approximately in the range of 200-260 degrees Fahrenheit and a pressure approximately in the range of 2-12 pounds per square inch.

In an embodiment, at least partially curing the mixture 1006 includes heating the base of the formation mold 1000. In an embodiment, at least partially curing the mixture 1006 includes heating both the mixture 1006 and the transparent foundation layer 1001. This approach may alleviate compression stress that may otherwise result upon cooling of a molded polishing surface layer if the transparent foundation layer 1001 is not heated. In an embodiment, at least partially curing the mixture 1006 forms the molded homogeneous polishing surface layer 1012 covalently bonded with the transparent foundation layer 1001.

Figure 10F:
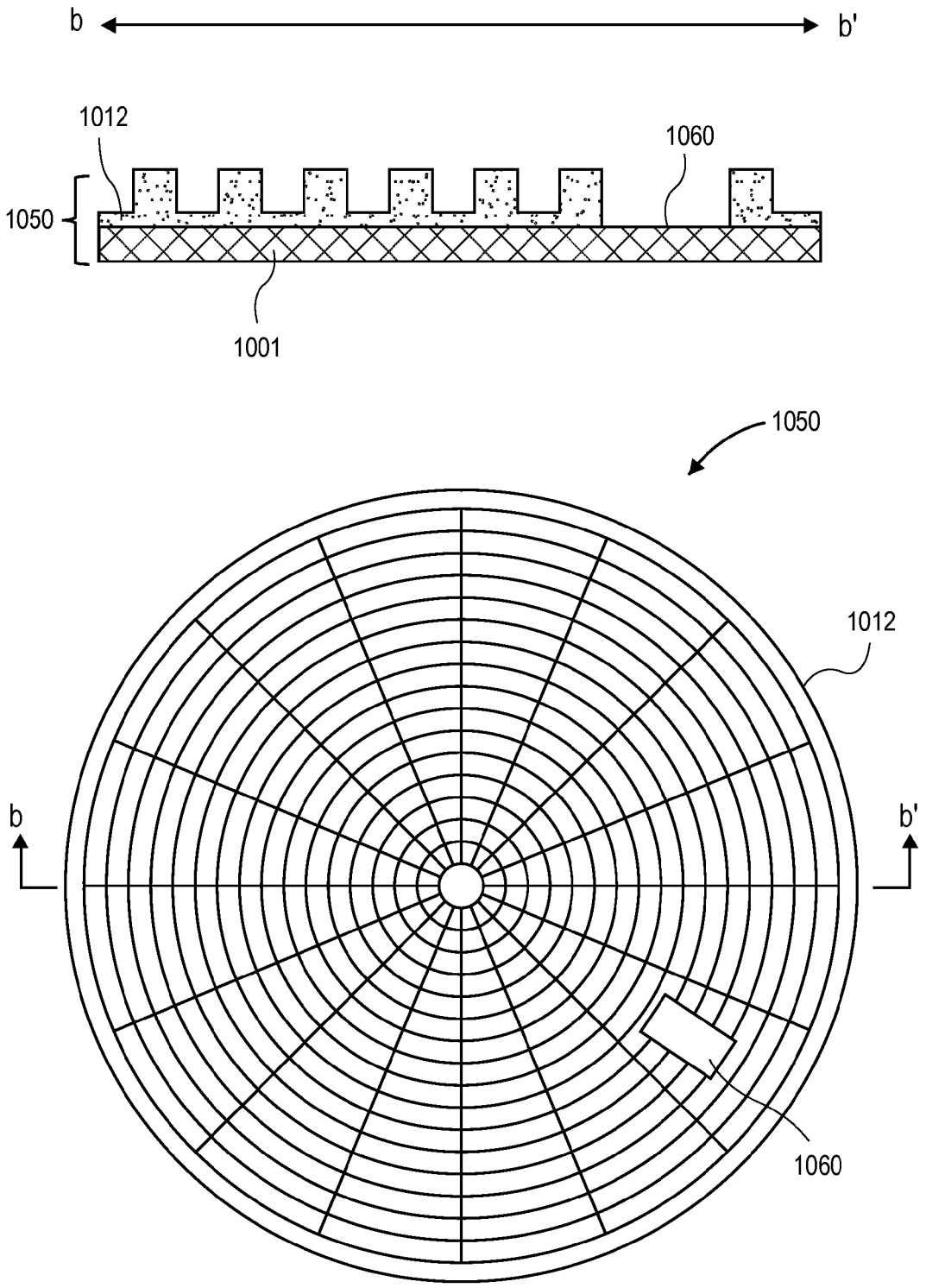

Referring to FIG. 10F, a polishing pad 1050 is provided upon removal of the coupled transparent foundation layer 1001 and molded polishing surface layer 1012 from the formation mold 1000. The polishing surface layer 1012 has a pattern of grooves corresponding to the pattern of protrusions of the lid 1008. A top-down plan view of the polishing pad 1050 is shown below, while a cross-section taken along the b-b' axis is shown above in FIG. 10F. In an embodiment, as shown in FIG. 10F, the polishing surface layer 1012 is formed from a continuous layer with protrusions formed there from (to form the groove pattern). In another embodiment, however, a polishing surface layer is formed from discrete protrusions (to form a groove pattern). In either case, the polishing surface layer 1012 may be composed of a material or have properties similar or the same as the materials and properties of the polishing surface layers described above.

The molded homogeneous polishing surface layer 1012 includes an opening or aperture 1060 (aperture in the case of FIG. 10F) therein, corresponding to the aperture forming feature 1011 of the lid 1008. In an embodiment, the opening or aperture 1060 is made to ultimately extend through the entire polishing surface layer 1012 and is an aperture for the polishing surface layer 1012, as shown in FIG. 10F. In other embodiments, the opening or aperture 1060 is made to not extend through the entire polishing surface layer 1012 and is an opening for the polishing surface layer 1012. Either way, opening or aperture 1060 may be formed during molding or during a subsequent removal of a portion of a material included in the polishing surface layer 1012. For example, in one embodiment, forming the molded homogeneous polishing surface layer 1012 includes forming an aperture disposed in molded homogeneous polishing surface layer 1012 at the time of molding, as depicted in FIG. 10E. In another embodiment, however, a portion of the homogeneous polishing surface layer 1012 is removed subsequent to molding. That is, the aperture is formed by removing a portion of the molded material. In another embodiment, a placeholder insert is included in the molding process and subsequently removed to form the aperture.

By including a foundation layer in the molding process, efficiency may be built into the molding process with respect to timing of demolding a fabricated pad from the formation mold. For example, in an embodiment, removal of the coupled transparent foundation layer 1001 and molded polishing surface layer 1012 from the formation mold 1000 (e.g., removal of polishing pad 1050) is performed when the extent of curing is sufficient to maintain geometry of the molded homogeneous polishing surface layer 1012 but insufficient for the molded homogeneous polishing surface layer 1012 to withstand mechanical stress. That is, the removal is performed prior to removal of a solo molded homogeneous polishing surface layer could otherwise be performed in the absence of a foundation layer. In one such embodiment, the transparent foundation layer 1001 having the molded homogeneous polishing surface layer 1012 attached thereto is removed from the base of the formation mold 1000 less than approximately 4 minutes after coupling the pattern of grooves of the formation mold of lid 1008 with the mixture 1006. Such timing may reflect an approximately three-fold reduction in time for the molding process, enabling greater throughput in a given individual mold. In an embodiment, removal of the coupled transparent foundation layer 1001 and molded polishing surface layer 1012 from the formation mold 1000 is performed immediately after the material of the molded homogeneous polishing surface layer 1012 gels.

In addition to adding backing support, a transparent foundation layer may additionally be sized larger than the polishing surface layer 1012 to further enable an earlier demolding time. For example, in one embodiment (not shown), a foundation layer extends beyond a molded homogeneous polishing surface layer, and removing the transparent foundation layer having the molded homogeneous polishing surface layer formed thereon from the base of the formation mold includes taking hold of the transparent foundation layer but not the molded homogeneous polishing surface layer. In an embodiment, the portion of the foundation layer extending beyond the molded homogeneous polishing surface layer is removed, e.g., by cutting away the extended portion. In an alternative embodiment, the molded homogeneous polishing surface layer extends beyond the foundation layer. In one such embodiment, the polishing surface layer partially encapsulates the foundation layer to hinder delamination from the foundation layer.

It is noted that further curing of the polishing surface layer 1012 through heating may be desirable and may be performed by placing the polishing pad 1050 in an oven and heating. Thus, in one embodiment, curing the mixture 1006 includes first partially curing in the formation mold 1000 and then further curing in an oven. Either way, a polishing pad 1050 is ultimately provided, wherein a molded polishing surface layer 1012 is formed on a transparent foundation layer 1001. In an embodiment, the molded polishing surface layer 1012 is composed of a thermoset polyurethane material with a plurality of closed cell pores disposed in the thermoset polyurethane material.

By including a foundation layer in the molding process, further processing of a fabricated pad there from may be reduced or eliminated. For example, conventional molding may require subsequent back-side cutting of the body of a polishing pad. However, in an embodiment, a polishing pad (e.g., polishing pad 1050) including the transparent foundation layer 1001 having the molded homogeneous polishing surface layer 1012 formed thereon is suitable for performing a polishing process without performing a backside cut of the transparent foundation layer 1001, or of the polishing pad 1050 in general.

By including a transparent foundation layer in the molding process, recycling or reuse of materials may be made possible. For example, in an embodiment, the molded homogeneous polishing surface layer 1012 is removed from the transparent foundation layer 1001, and a second homogeneous polishing surface layer is formed on the transparent foundation layer. Such a reuse process of the transparent foundation layer 1001 may be performed after the life of the polishing surface layer and, thus, the life of the polishing pad is determined to have terminated in a CMP facility. In another such embodiment, providing the transparent foundation layer 1001 in the formation mold 1000 includes first removing a previously formed polishing surface layer from the transparent foundation layer 1001.

In an embodiment, referring again to FIG. 10B, the mixing further includes adding a plurality of porogens 1022 to the pre-polymer 1002 and the curative 1004 to provide closed cell pores in the ultimately formed polishing pad. Thus, in one embodiment, each closed cell pore has a physical shell. In another embodiment, referring again to FIG. 10B, the mixing further includes injecting a gas 1024 into to the pre-polymer 1002 and the curative 1004, or into a product formed there from, to provide closed cell pores in the ultimately formed polishing pad. Thus, in one embodiment, each closed cell pore has no physical shell. In a combination embodiment, the mixing further includes adding a plurality of porogens 1022 to the pre-polymer 1002 and the curative 1004 to provide a first portion of closed cell pores each having a physical shell, and further injecting a gas 1024 into the pre-polymer 1002 and the curative 1004, or into a product formed there from, to provide a second portion of closed cell pores each having no physical shell. In yet another embodiment, the pre-polymer 1002 is an isocyanate and the mixing further includes adding water ($H_2O$) to the pre-polymer 1002 and the curative 1004 to provide closed cell pores each having no physical shell.

Thus, groove or protrusion patterns contemplated in embodiments of the present invention may be formed in-situ. Furthermore, openings or apertures in a polishing layer may also be formed simultaneously in the molding fabrication process. For example, as described above, a compression-molding process may be used to form polishing pads with a grooved polishing surface layer having an aperture or opening disposed therein. By using a molding process, highly uniform groove dimensions within-pad may be achieved. Furthermore, extremely reproducible groove dimensions along with very smooth, clean groove surfaces may be produced. Other advantages may include reduced defects and micro-scratches and a greater usable groove depth.

Also, since the fabricated aperture or opening is formed during the molding, the positioning of the resulting pad during formation of a pad in a mold can be determined after removal of the pad from the mold. That is, such an aperture or opening can provide traceability back to the molding process. Thus, in one embodiment, the polishing surface layer of a polishing pad is a molded polishing surface layer, and an aperture or opening included therein indicates a location of a region in a mold used for forming the molded polishing surface layer.

In an embodiment, polishing pads described herein, such as polishing pads 200, 300A, 300B, 300C, 400, 500, 600, 700, 800 or 900, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities. In an embodiment, a polishing pad has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters.

Polishing pads described herein may be suitable for use with a variety of chemical mechanical polishing apparatuses. As an example, FIG. 11 illustrates an isometric side-on view of a polishing apparatus compatible with a polishing pad with a transparent foundation layer and a polishing surface layer with an aperture or opening therein, in accordance with an embodiment of the present invention.

Figure 11:
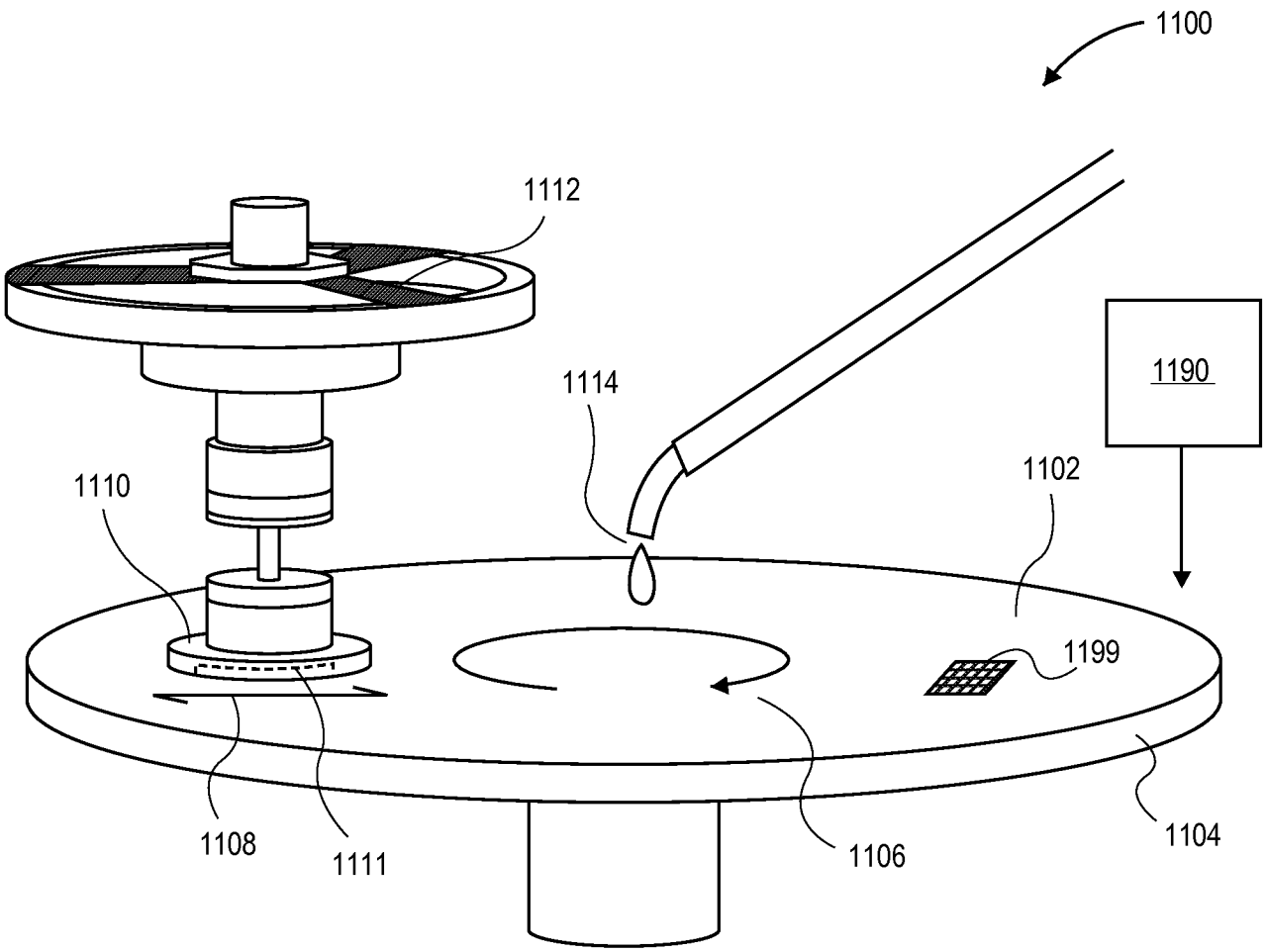
FIG. 11 illustrates an isometric side-on view of a polishing apparatus compatible with a polishing pad with a transparent foundation layer and a polishing surface layer with an aperture or opening therein, in accordance with an embodiment of the present invention.

Referring to FIG. 11, a polishing apparatus 1100 includes a platen 1104. The top surface 1102 of platen 1104 may be used to support a polishing pad with a transparent foundation layer and a polishing surface layer having an aperture or opening therein. Platen 1104 may be configured to provide spindle rotation 1106 and slider oscillation 1108. A sample carrier 1110 is used to hold, e.g., a semiconductor wafer 1111 in place during polishing of the semiconductor wafer with a polishing pad. Sample carrier 1110 is further supported by a suspension mechanism 1112. A slurry feed 1114 is included for providing slurry to a surface of a polishing pad prior to and during polishing of the semiconductor wafer. A conditioning unit 1190 may also be included and, in one embodiment, includes a diamond tip for conditioning a polishing pad.

In accordance with an embodiment of the present invention, an aperture or opening in a polishing surface of a polishing pad disposed on a transparent foundation layer, such as an aperture or opening described in association with FIG. 2, 3A-3C, 4, 5, 6, 7, 8 or 9, is positioned for alignment with an optical detection device 1199 disposed on or within the platen 1104 of polishing apparatus 1100, as depicted in FIG. 11. In an embodiment, an aperture or opening of a polishing pad is sized to accommodate the optical detection device 1199 without being so big as to significantly impact polishing performance of the polishing pad. In an embodiment, an adhesive sheet is used to couple a polishing pad having an aperture or opening in a polishing surface disposed on a transparent foundation layer on the platen 1104.

As described above, in an embodiment, modern slurries are essentially transparent and will not attenuate or scatter a detection beam as early-generation slurries may otherwise have. Constant flow of slurry across an aperture opening may keep the opening free of debris. In one embodiment, a molding process is suitable for creating the opening during molding, so no extra manufacturing operations are needed. For windowless design features, in an embodiment, the purpose of each feature is to enable constant flushing of the opening with slurry during use. Features may be used individually or in combination. As described above, and in accordance with one or more embodiments of the present invention, one such feature may be a wedge or ramp shape of one or more edges of the opening. Another such feature may include one or more grooves connected with the opening. Radial grooves, circumferential grooves, or a combination thereof may be connected or continuous with the opening. The groove depth may be equal to the opening depth where they connect, with the groove floor ramping up to normal groove depth. Blocked or diverted flow of some grooves may be used so that they do not drain into the opening. A rounded shape of some or all of the corners of the opening may also be used.

In reference to polishing apparatus 1100 and one or more polishing pads described in association with 2, 3A-3C, 4, 5, 6, 7, 8 or 9, a method of polishing a substrate includes disposing a polishing pad above a platen of a chemical mechanical polishing apparatus. A chemical mechanical polishing slurry is dispensed on the polishing surface of the polishing pad. A substrate is polished with the chemical mechanical polishing slurry at the polishing surface of the polishing pad. The polishing of the substrate is monitored, through the aperture, with an optical monitoring device coupled with the platen. In an embodiment, polishing the substrate with the chemical mechanical polishing slurry includes dispensing a slurry of sufficient transparency for monitoring the polishing of the substrate with the optical monitoring device. In a specific such embodiment, dispensing the slurry of sufficient transparency includes dispensing a slurry having greater than approximately 80% transmission of a wavelength of light emitted from the optical monitoring device. In another specific such embodiment, dispensing the slurry of sufficient transparency includes dispensing a slurry having less than approximately 1% of opaque components.

Thus, polishing pads with a polishing surface layer having an aperture or opening above a transparent foundation layer have been disclosed. In accordance with an embodiment of the present invention, a polishing pad for polishing a substrate includes a transparent foundation layer having a global top surface. A polishing surface layer is attached to the global top surface of the transparent foundation layer. The polishing surface layer has a polishing surface and a back surface. An aperture is disposed in the polishing pad from the back surface through to the polishing surface of the polishing surface layer. The transparent foundation layer provides an impermeable seal for the aperture at the back surface of the polishing surface layer. In one embodiment, the aperture is disposed over the global top surface of the transparent foundation layer. In one embodiment, the aperture is disposed over an opening formed in the transparent foundation layer, and the bottom of the opening is below the global top surface of the transparent foundation layer. In one embodiment, the aperture is disposed over a protrusion formed from the transparent foundation layer, and the top of the protrusion is above the global top surface of the transparent foundation layer and located within the aperture.

What is claimed is:

1. A polishing pad for polishing a substrate, the polishing pad comprising:

a foundation layer having a global top surface and a transparent region;

a polishing surface layer attached to the global top surface of the foundation layer, the polishing surface layer having a polishing surface and a back surface; and an aperture disposed in the polishing pad from the back surface through to the polishing surface of the polishing surface layer and aligned with the transparent region of the foundation layer, wherein the transparent region of the foundation layer provides an impermeable seal for the aperture at the back surface of the polishing surface layer, wherein the aperture is disposed over a trench formed in but not through the transparent region of the foundation layer, and wherein the trench comprises side surfaces and a bottom surface that acts as a slurry deflection feature comprising the bottom surface as a single planar surface with an uppermost height at a first side of the trench sloped down to a lowermost height at a second side of the trench.

2. The polishing pad of claim 1, wherein the entire foundation layer is transparent.

3. The polishing pad of claim 1, wherein the foundation layer has a first hardness, and the polishing surface layer has a second hardness different from the first hardness.

4. The polishing pad of claim 1, wherein the polishing surface layer is bonded directly to the foundation layer.

5. The polishing pad of claim 3, wherein the polishing surface layer is covalently bonded to the foundation layer.

6. The polishing pad of claim 1, wherein the polishing surface layer comprises a continuous layer portion with a plurality of polishing features protruding there from, the continuous layer portion attached to the foundation layer.

7. The polishing pad of claim 1, wherein the polishing surface layer comprises a plurality of discrete polishing protrusions attached to the foundation layer.

8. The polishing pad of claim 1, wherein the foundation layer and the polishing surface layer have a peel resistance sufficient to withstand a shear force applied during the useful lifetime of the polishing pad.

9. The polishing pad of claim 1, wherein the foundation layer has a smooth surface with a surface roughness less than approximately 1 micrometer Ra (root mean square) where the polishing surface layer is attached to the foundation layer.

10. The polishing pad of claim 1, wherein the foundation layer has a surface roughness greater than approximately 1 micrometer Ra (root mean square) where the polishing surface layer is attached to the foundation layer.

11. The polishing pad of claim 10, wherein the surface roughness is approximately in the range of 5-10 micrometers Ra (root mean square).

12. The polishing pad of claim 1, wherein the polishing surface layer comprises a polyurethane material and the foundation layer comprises a polycarbonate material or a polyethylene terephthalate (PET) material.

13. The polishing pad of claim 1, wherein the foundation layer has an energy loss factor of less than approximately 100 KEL at 1/Pa at 40° C., a compressibility of less than approximately 1% under an applied pressure of 5 PSI, a hardness greater than approximately 75 Shore D, and comprises a polycarbonate material or a polyethylene terephthalate (PET) material.

14. The polishing pad of claim 1, wherein the polishing surface layer has an energy loss factor of greater than approximately 1000 KEL at 1/Pa at 40° C., a compressibility of greater than approximately 0.1% under an applied pressure of 5 PSI, a hardness less than approximately 70 Shore D, and comprises a thermoset polyurethane material.

15. The polishing pad of claim 1, wherein the polishing surface layer is a homogeneous polishing surface layer and has a pore density of closed cell pores approximately in the range of 6%-50% total void volume.

16. The polishing pad of claim 1, wherein the polishing surface layer has a first modulus of elasticity, and the foundation layer has a second modulus of elasticity greater than approximately 5 times the first modulus of elasticity.

17. The polishing pad of claim 1, wherein the polishing surface layer has a thickness approximately in the range of 2-50 mils, and the foundation layer has a thickness of greater than approximately 20 mils.

18. The polishing pad of claim 17, wherein the polishing surface layer has a thickness approximately in the range of 10-30 mils and a groove depth approximately in the range of 50-100% of the thickness of the polishing surface layer, and the foundation layer has a thickness approximately in the range of 40-80 mils.

19. The polishing pad of claim 1, wherein the foundation layer has a thickness and hardness relative to the thickness and hardness of the polishing surface layer sufficient to dictate the bulk polishing characteristics of the polishing pad.

20. The polishing pad of claim 1, wherein the foundation layer is sufficiently thick for the polishing pad to provide die-level polishing planarity, but sufficiently thin for the polishing pad to provide wafer-level polishing uniformity.

21. The polishing pad of claim 1, wherein the foundation layer comprises a stack of sub layers.

22. The polishing pad of claim 1, wherein the transparent region of the foundation layer is substantially transparent to light selected from the group consisting of visible light, ultra-violet light, infra-red light, and a combination thereof.

23. The polishing pad of claim 22, wherein the transparent region of the foundation layer transmits approximately 80% or more of incident light in the 350-750 nanometer range.

24. The polishing pad of claim 1, wherein the transparent region of the foundation layer is effectively transparent for transmission of light for end-point detection.

25. The polishing pad of claim 1, wherein the transparent region of the foundation layer is nonporous.

26. The polishing pad of claim 1, wherein the foundation layer extends beyond the polishing surface layer.

27. The polishing pad of claim 1, wherein the polishing surface layer extends beyond the foundation layer.

28. The polishing pad of claim 1, further comprising:

a sub pad having an aperture, wherein the foundation layer is disposed proximate to the sub pad, and wherein the aperture of the sub pad is aligned with the transparent region of the foundation layer.

29. A polishing pad for polishing a substrate, the polishing pad comprising:

a foundation layer having a global top surface and a transparent material region;

a polishing surface layer attached to the global top surface of the foundation layer, the polishing surface layer having a polishing surface and a back surface; and a grooveless opening disposed in the polishing pad from the polishing surface, but not through to the back surface, of the polishing surface layer, the opening aligned with the transparent material region of the foundation layer, wherein the grooveless opening comprises side surfaces and a sloped bottom surface that acts as a slurry deflection feature comprising the bottom surface as a single planar surface with an uppermost height at a first side of the trench sloped down to a lowermost height at a second side of the trench.

30. The polishing pad of claim 29, wherein the entire foundation layer is transparent.

31. The polishing pad of claim 29, wherein the opening is disposed over the global top surface of the foundation layer.

32. The polishing pad of claim 29, wherein the opening is disposed over an opening formed in the transparent material region of the foundation layer, and wherein the bottom of the opening of the foundation layer is below the global top surface of the foundation layer.

33. The polishing pad of claim 29, wherein the opening is disposed over a protrusion formed from the transparent material region of the foundation layer, the top of the protrusion above the global top surface of the foundation layer.

34. The polishing pad of claim 29, wherein the foundation layer has a first hardness, and the polishing surface layer has a second hardness different from the first hardness.

35. The polishing pad of claim 29, wherein the polishing surface layer is bonded directly to the foundation layer.

36. The polishing pad of claim 35, wherein the polishing surface layer is covalently bonded to the foundation layer.

37. The polishing pad of claim 29, wherein the polishing surface layer comprises a continuous layer portion with a plurality of polishing features protruding there from, the continuous layer portion attached to the foundation layer.

38. The polishing pad of claim 29, wherein the polishing surface layer comprises a plurality of discrete polishing protrusions attached to the foundation layer.

39. The polishing pad of claim 29, wherein the foundation layer and the polishing surface layer have a peel resistance sufficient to withstand a shear force applied during the useful lifetime of the polishing pad.

40. The polishing pad of claim 29, wherein the foundation layer has a smooth surface with a surface roughness less than approximately 1 micrometer Ra (root mean square) where the polishing surface layer is attached to the foundation layer.

41. The polishing pad of claim 29, wherein the foundation layer has a surface roughness greater than approximately 1 micrometer Ra (root mean square) where the polishing surface layer is attached to the foundation layer.

42. The polishing pad of claim 41, wherein the surface roughness is approximately in the range of 5-10 micrometers Ra (root mean square).

43. The polishing pad of claim 29, wherein the polishing surface layer comprises a polyurethane material and the foundation layer comprises a polycarbonate material or a polyethylene terephthalate (PET) material.

44. The polishing pad of claim 29, wherein the foundation layer has an energy loss factor of less than approximately 100 KEL at 1/Pa at 40° C., a compressibility of less than approximately 1% under an applied pressure of 5 PSI, a hardness greater than approximately 75 Shore D, and comprises a polycarbonate material.

45. The polishing pad of claim 29, wherein the polishing surface layer has an energy loss factor of greater than approximately 1000 KEL at 1/Pa at 40° C., a compressibility of greater than approximately 0.1% under an applied pressure of 5 PSI, a hardness less than approximately 70 Shore D, and comprises a thermoset polyurethane material.

46. The polishing pad of claim 29, wherein the polishing surface layer is a homogeneous polishing surface layer and has a pore density of closed cell pores approximately in the range of 6%-50% total void volume.

47. The polishing pad of claim 29, wherein the polishing surface layer has a first modulus of elasticity, and the foundation layer has a second modulus of elasticity greater than approximately 5 times the first modulus of elasticity.

48. The polishing pad of claim 29, wherein the polishing surface layer has a thickness approximately in the range of 2-50 mils, and the foundation layer has a thickness of greater than approximately 20 mils.

49. The polishing pad of claim 48, wherein the polishing surface layer has a thickness approximately in the range of 10-30 mils and a groove depth approximately in the range of 50-100% of the thickness of the polishing surface layer, and the foundation layer has a thickness approximately in the range of 40-80 mils.

50. The polishing pad of claim 29, wherein the foundation layer has a thickness and hardness relative to the thickness and hardness of the polishing surface layer sufficient to dictate the bulk polishing characteristics of the polishing pad.

51. The polishing pad of claim 29, wherein the foundation layer is sufficiently thick for the polishing pad to provide die-level polishing planarity, but sufficiently thin for the polishing pad to provide wafer-level polishing uniformity.

52. The polishing pad of claim 29, wherein the foundation layer comprises a stack of sub layers.

53. The polishing pad of claim 29, wherein the combination of the transparent material region of the foundation layer and the portion of the back surface of the polishing surface layer underneath the opening is substantially transparent to light selected from the group consisting of visible light, ultra-violet light, infra-red light, and a combination thereof.

54. The polishing pad of claim 53, wherein the combination of the transparent material region of the foundation layer and the portion of the back surface of the polishing surface layer underneath the opening transmits approximately 80% or more of incident light in the 350-750 nanometer range.

55. The polishing pad of claim 29, wherein the combination of the transparent material region of the foundation layer and the portion of the back surface of the polishing surface layer underneath the opening is effectively transparent for transmission of light for end-point detection.

56. The polishing pad of claim 29, wherein the transparent material region of the foundation layer is nonporous.

57. The polishing pad of claim 29, wherein the foundation layer extends beyond the polishing surface layer.

58. The polishing pad of claim 29, wherein the polishing surface layer extends beyond the foundation layer.

59. The polishing pad of claim 29, further comprising:

a sub pad having an aperture, wherein the foundation layer is disposed proximate to the sub pad, and wherein the aperture of the sub pad is aligned with the transparent material region of the foundation layer.

* * * * *